US006494215B2

(12) United States Patent
Gueret

(10) Patent No.: US 6,494,215 B2
(45) Date of Patent: Dec. 17, 2002

(54) DEVICE, ASSEMBLY, AND METHOD FOR APPLYING A PRODUCT TO KERATINOUS FIBERS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/902,601

(22) Filed: Jul. 12, 2001

(65) Prior Publication Data

US 2002/0020426 A1 Feb. 21, 2002

(30) Foreign Application Priority Data

Jul. 12, 2000 (FR) ..... 00 09115

(51) Int. Cl.[7] ..... A45D 40/26
(52) U.S. Cl. ..... 132/218
(58) Field of Search ..... 132/218, 317; 15/206; 401/122, 126, 129

(56) References Cited

U.S. PATENT DOCUMENTS

| | | | | |
|---|---|---|---|---|
| 4,403,624 A | | 9/1983 | Montgomery | |
| 4,898,193 A | | 2/1990 | Gueret | |
| 5,197,497 A | | 3/1993 | Gueret | |
| 5,335,465 A | | 8/1994 | Gueret | |
| 5,542,439 A | | 8/1996 | Gueret | |
| 5,595,198 A | | 1/1997 | Kemmerer | |
| 5,611,361 A | | 3/1997 | Leone | |
| 5,862,812 A | * | 1/1999 | Dumler | 132/218 |
| 5,876,138 A | * | 3/1999 | Gueret | 132/218 |
| 5,918,994 A | * | 7/1999 | Gueret | 132/218 |
| 5,937,870 A | | 8/1999 | Gueret | |
| 6,003,519 A | | 12/1999 | Gueret | |
| 6,220,254 B1 | | 4/2001 | Gueret | |
| 6,227,735 B1 | | 5/2001 | Gueret | |
| 6,237,609 B1 | * | 5/2001 | Vasas | 132/218 |

FOREIGN PATENT DOCUMENTS

| | | |
|---|---|---|
| EP | 0 410 821 | 1/1991 |
| EP | 0 611 170 | 8/1994 |
| EP | 0 916 282 | 5/1999 |
| FR | 2 605 505 | 4/1988 |
| FR | 2 715 038 | 7/1995 |

* cited by examiner

*Primary Examiner*—Todd E. Manahan
(74) *Attorney, Agent, or Firm*—Finnegan, Henderson, Farabow, Garrett & Dunner, LLP

(57) ABSTRACT

A device for applying a product to keratinous fibers comprises a tail having a longitudinal axis X and an application element extending from an end of the tail. The application element may comprise at least a first face and a second face, each of the faces being delimited by two longitudinal edges and extending over at least part of a length of the application element. The first face may form with the axis X a first non-zero angle α having a vertex oriented toward a first end of the application element, and wherein the second face may form with the axis X a second non-zero angle β having a vertex oriented toward a second end of the application element. The second end of the application element may be opposite to the first end.

254 Claims, 7 Drawing Sheets

Fig. 1B
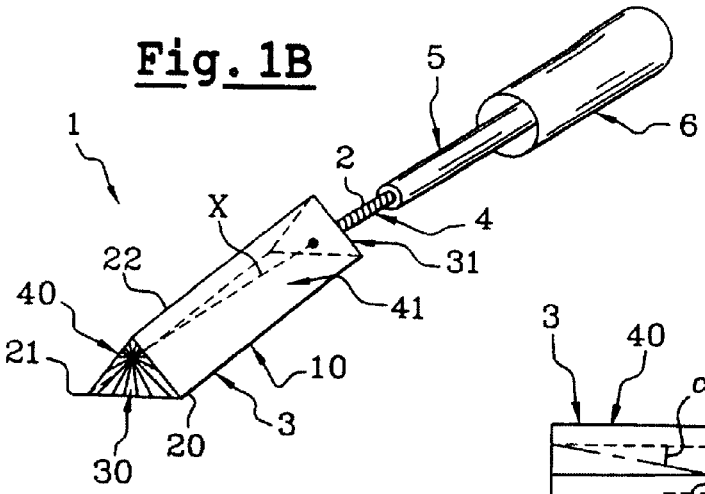
Fig. 1A
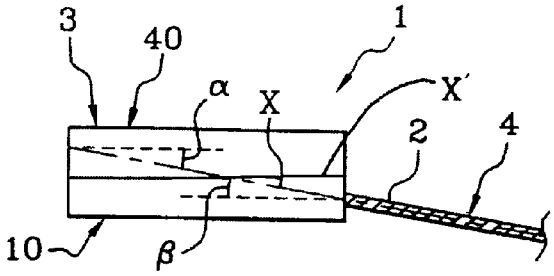
Fig. 2
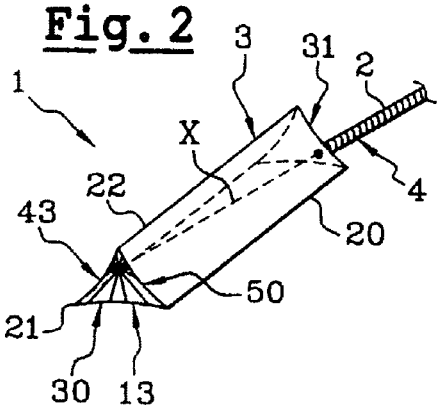
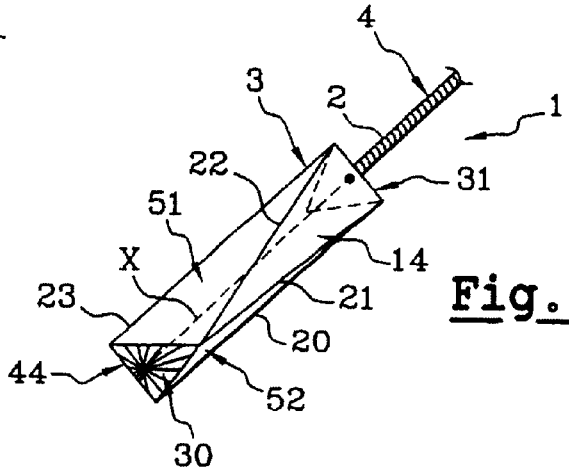
Fig. 3
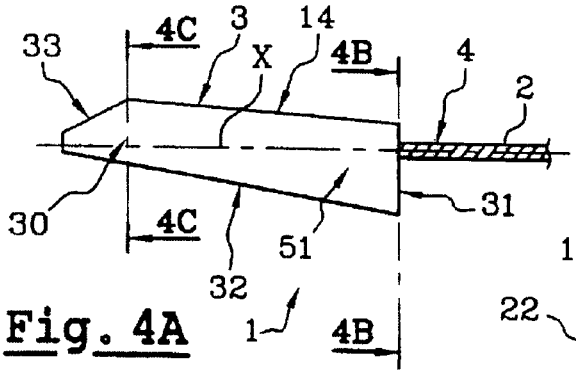
Fig. 4A
Fig. 4B
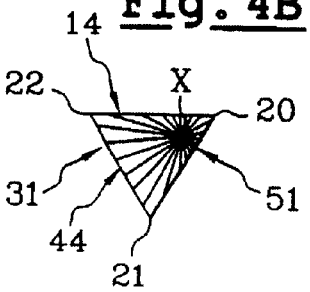
Fig. 4C
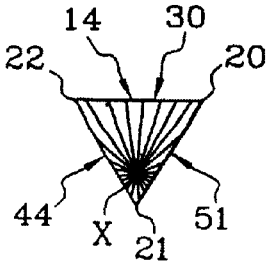

DEVICE, ASSEMBLY, AND METHOD FOR APPLYING A PRODUCT TO KERATINOUS FIBERS

The present invention relates to a device for applying a product to keratinous fibers, for example to eyelashes, eyebrows, moustaches, hair or other similar fibers. Such a device may be suitable for applying a make-up product, such as a mascara or the like, to eyelashes or eyebrows, and/or a care product.

The present invention also may relate to brushes, sometimes referred to as "twisted brushes." Such twisted brushes may be obtained by arranging bristles between two branches of wire, which may be configured as a hairpin, and then twisting the two branches of the wire about its axis. The twisted wire forms a double helix (i.e., one helix for each wire branch). The turns of the helix, depending on the direction of twisting of the wire, may rise either from the left to the right or from the right to the left when the brush is observed vertically from the front. The first type of twisting, i.e., wherein the turns rise from the left to the right, makes it possible to obtain a brush sometimes referred to as a "left-hand brush". Such a brush is described in EP 0 611 170 in the name of the present Applicant. The second type of twisting, i.e., wherein the turns rise from the right to the left, makes it possible to obtain a brush sometimes referred to as a "right-hand brush". Such twisted brushes generally comprise a "bristled" portion defining an application element. This bristled portion may be extended by a "non-bristled" portion of the twisted wire, referred to herein as the "tail" of the brush. The tail may be used for fastening the device to a stem, which may be connected to a handling member for gripping the device.

The present invention also relates to applicator devices obtained by molding, such as molding thermoplastics, including, for example, polyethylenes or polypropylenes. Such molded devices also may comprise a "tail" for fastening the device to a stem. Alternatively, the tail itself may form the stem. Applicator devices may also be obtained by machining, casting, or stamping, and materials other than thermoplastics may be used.

In some conventional applicator devices, the cross-section of the application element is substantially centered with respect to the longitudinal axis of the tail. Thus, regardless of the angular position of the device, at any given axial position of the device, the distribution of the product around the device may be substantially uniform. However, during application, it may be found that from time to time, for a given area of the keratinous fibers, for example, eyelashes on the eyelid, there may be too much product and it may be desirable to be able to spread the product to other areas. Conversely, from time to time the user may not have enough product in one place and would like to add to it. To apply the product properly, therefore, may require manipulations of the brush with respect to the eyelashes or other keratinous fibers. Such manipulations may require some practice by the user.

FR-A-2 715 038 describes a structure having one or more cut faces. According to certain embodiments, the structure comprises a single cut face which may or may not be parallel to the axis of the brush tail. Such a cut face extends over a major part of the brush. The brush terminates in an end portion in the form of a truncated cone which does not define any face bounded by two longitudinal edges. Alternatively, the brush comprises two cut faces parallel to the brush tail axis. In the end, the resulting structure is relatively symmetrical about the brush tail axis.

FR 2 605 505 describes a twisted brush, forming the subject of a series of cutting operations so as to define a plurality of faces which are either parallel to the brush tail axis or are all inclined in the same direction, especially in the direction of a free end of the brush. In each case, the structure thus formed is symmetrical about the brush tail axis.

Another type of brush, obtained by molding, is described in U.S. Pat. No. 4,403,624. The brush described in this document comprises a row of tines whose free end forms a beveled edge. These tines are intended for combing the eyelashes. Other tines are oriented radially about a portion of the brush axis and used for applying the product. The profile for loading the product, because of the configuration of the brush, is relatively binary and no way progressive. Only the radially oriented tines on an angular portion of the brush can be used effectively to apply the product.

EP-A-0 410 821 describes a twisted brush whose cross-section rotates from one end of the brush to the other, so that peak lines are defined and define at least one helix at the surface of the brush. The faces defined by the brush are either parallel to the brush tail axis or inclined in the same direction.

It is one of the optional objects of the present invention to produce a device for applying a product to keratinous fibers, such as the eyelashes or eyebrows, for example, that solves, completely or partly, the problems discussed above with reference to the devices of the prior art.

In particular, it is an optional object of the invention to produce a device for applying a product to keratinous fibers, for example to the eyelashes or eyebrows, which may be relatively simple to use and may require a shorter learning phase for the user as compared to conventional devices.

It is another optional object of the invention to produce an application device, such as for mascara or other care products, that may make it possible over at least part of a length of the application element to obtain an amount of product that varies according to the angular position on the application element. The amount of product also may vary along the application element in at least one gradual profile.

It is another optional object of the invention to produce an application device which may make it possible to apply the desired amount of product and to separate the fibers to be treated with substantially the same movement, or with a movement that is continuous with the movement intended for applying the product.

It is yet another optional object of the invention to produce an application device which may allow for progressive coating of the fibers to be treated. With respect to the eyelashes such progressive coating may assist in lengthening and/or curling them.

Yet more optional objects may appear in the following detailed description.

The devices and methods of dispensing described herein may optionally solve some or all of the problems discussed above with reference to conventional dispensing devices and methods. It should be understood that the invention could be practiced without performing one or more of the optional objects and/or advantages described above. Certain other optional aspects of the invention will become apparent from the detailed description which follows.

According to a first optional aspect of the invention, a device for applying a product to keratinous fibers comprises a tail having a longitudinal axis X and an application element extending from an end of the tail. The application element comprises at least a first face and a second face. Each of the faces may be delimited by two longitudinal edges and may extend over at least part of a length of the application element. The first face may form with the axis X a first non-zero angle $\alpha$ having a vertex oriented toward a first end of the application element, and the second face may form with the axis X a second non-zero angle $\beta$ having a vertex oriented toward a second end of the application element. The second end may be opposite to the first end.

Thus, for example, the first non-zero angle $\alpha$ may comprise an opening turned toward the tail of the application device. The second non-zero angle $\beta$ in this example may have an opening turned away from the tail of the application device, and also from the opening of the first angle $\alpha$. In other words, the vertex of the angle $\alpha$ is turned toward one end of the application device and the vertex of the angle $\beta$ is turned toward an opposite end of the application device as the angle $\alpha$.

Optionally, the first and second faces denote two faces each having at least one length portion with which the eyelashes may be brought into engagement, in succession, without an appreciable axial movement of the brush with respect to the eyelashes. The faces may, for example, be arranged opposite to each other with respect to the axis, or they may be adjacent to each other. In other words, the first and second faces may be in a different angular position around the axis X but may overlap along the axis X, i.e., extend over substantially the same axial position, at least partially, or even over their entire length.

Because of the configuration of the applicator device according to the invention, a structure is produced which may be relatively easy to use, even by a novice. The edges defining the faces of the application element may fulfil the role of separating the fibers to be treated. Their oblique orientation with respect to the brush axis may also, during the natural movement of brushing the fibers, such as, for example, by a slight rotation of the device about the tail axis, progressive penetration of the bristles or tines of the device between the fibers to be treated.

Furthermore, the oblique and reversed orientations of the first and second faces may make it possible to create transverse orientations of the fibers with respect to the bristles, tines, or other application members of the application element, so as to coat the fibers and to grip them. This may allow for lengthening of and/or curling of the fibers. The reverse orientations of the first and second faces optionally generate a dissymmetry, or eccentricity. Such eccentricity may be enhanced if the first and second faces are located substantially opposite one another. This may form an application element capable, for a given axial position on the device, of producing a variable product-coating profile all around the application element. This is because when the application element passes through a wiping member forming part of an assembly with which the application device is associated, the wiping of a first point of the application element located at a first angular position, may differ from the wiping of a second point of the application element located at a second angular position and at substantially the same axial position as the first location. Because of the both oblique and reverse orientation of the faces with respect to the tail of the device, the coating of the first and second points may change, one with respect to the other, both reversibly and progressively along the application element from the first point to the second point.

Thus, in terms of application characteristics, it may be found that a brush of the "right-hand brush" type has advantages, such as those relating to the coating of the fibers to be treated for the purpose of lengthening them that often may be found in conventional brushes of the "left-hand brush" type. However, in the brushes of the present invention, greater ease of use, especially for a make-up novice, for example, and greater ability to deposit more product on the fibers to be treated may be found. It may be noted in particular that, upon application, the product may be almost immediately deposited uniformly. This is unlike some conventional application devices that may generate, at least at the start of applying the product, lumps. Such lumps may then be removed by relatively lengthy brushing, which may require the user to have at least some skill.

According to an optional characteristic of the invention, the device comprises at least two transverse cross-sections between which the first and second faces extend. The axis X may intersect the two end faces. In other words, despite its obliquity at least with respect to certain application faces, the axis X intersects the transverse cross-sections within the surface envelope of the application device (i.e., the volume defined by the outer surface of the application element). This characteristic may permit, upon application, a rotational motion relative to the device with respect to the fibers to be treated, about the axis X. This relative rotational motion, because of the faces which are oblique with respect to the axis X, may cause the bristles, tines, or other similar application members of the device to progressively penetrate between the fibers to be treated.

According to yet another optional aspect, a device for applying a product to keratinous fibers comprises a tail having a first end, a second end, and a longitudinal axis X. The device further comprises an application element having an end extending from the first end of the tail. The application element may be oriented along a substantially straight direction. A substantially straight line passing through the center of gravity of at least two transverse cross-sections of the application element may extend in a different direction than the axis X. Optionally, the substantially straight line passing through the center of gravity of at least two transverse cross-sections of the application element may be non-parallel or substantially non-parallel to the axis X of the tail, and the substantially straight line may cross the axis X at a position located axially between the at least two transverse cross-sections. The center of gravity of each of the at least two transverse cross-sections may optionally be the geometric center of the cross-sections. This may be the case, for example, when the cross-sections are circular or have a regular polygonal shape.

Yet another optional aspect of the invention includes a device for applying a product to keratinous fibers comprising an application element formed from a curved twisted wire core holding a plurality of bristles. The application element may comprise at least two faces. Each of the faces may be delimited by two longitudinal edges and extending over at least part of a length of the application element. A line passing through a center of gravity of at least two transverse cross-sections of the application element may extend in a different direction than the twisted wire core, and the line may have a curvature that is substantially the same as the curvature of the twisted wire core. The line may optionally be substantially non-parallel to the twisted wire core, and may cross over (i.e., intersect or pass over each other in two different, parallel planes) the twisted wire core at a position located axially between the at least two transverse cross-sections. As used herein, the term "cross" encompasses situations in which two lines intersect each other and situations in which two lines are in differing parallel planes and pass over one another when viewed from at least one vantage point. The center of gravity of each of the at least two transverse cross-sections may optionally be the geometric center of the cross-sections. This may be the case, for example, when the cross-sections are circular or have a regular polygonal shape.

According to another optional aspect, a device for applying a product to keratinous fibers comprises an application element comprising a substantially straight twisted wire core holding a plurality of bristles. The application element may have at least two faces. Each of the faces may be delimited by two longitudinal edges and may extend over at least part of the length of the application element. A straight line passing through a center of gravity of the application element and being perpendicular to the at least two transverse cross-sections of the application element may be non-parallel, or substantially non-parallel, to the twisted wire core. The straight line may cross the twisted wire core at a position located axially between the at least two transverse cross-sections. Optionally, the two transverse cross-sections may be cross-sections taken in respective planes that are substantially perpendicular to the longitudinal axis of the application element.

According to yet another optional aspect, a device for applying a product to keratinous fibers comprises a tail having a first end, a second end, and a longitudinal axis X. The device further comprises an application element having an end extending from the first end of the tail. The application element may be oriented along a substantially straight direction. A substantially straight line passing through a center of gravity of a volume defined by an outer surface of the application element between a first transverse cross-section of the application element and a second transverse cross-section of the application element and being substantially perpendicular to the first and second transverse cross-sections may extend in a substantially different direction than the axis X. The substantially straight line optionally may be non-parallel or substantially non-parallel to the axis X and may intersect the first and second transverse cross-sections. As an optional example, the substantially straight line may intersect the first and second transverse cross-sections as their respective geometric centers. Optionally, the first and second transverse cross-sections may be cross-sections taken in respective planes that are substantially perpendicular to the longitudinal axis of the application element.

Yet another optional aspect of the invention includes a device for applying a product to keratinous fibers comprising an application element formed from a curved twisted wire core holding a plurality of bristles. The application element comprises at least two faces, each of the faces being delimited by two longitudinal edges and extending over at least part of a length of the application element. A substantially straight line may pass through a center of gravity of a volume defined by an outer surface of the application element between a first transverse cross-section of the application element and a second transverse cross-section of the application element. The substantially straight line may intersect the first transverse cross-section at a first point and intersect the second transverse cross-section at a second point, the substantially straight line being substantially perpendicular to the first transverse cross-section and the second transverse cross-section. A curved line having a curvature that is substantially the same as the curvature of the twisted wire core may pass through the first and second points and extend in a different direction than the twisted wire core. The curved line may be non-parallel or substantially non-parallel to the twisted wire core. The curved line optionally may be non-parallel or substantially non-parallel to the twisted wire core and may intersect the first transverse cross-section and the second transverse cross-section. As an optional example, the substantially straight line may intersect the first and second transverse cross-sections at their respective geometric centers. Optionally, the first and second transverse cross-sections may be cross-sections taken in respective planes that are substantially perpendicular to the longitudinal axis of the application element.

In yet another optional aspect of the invention, a device for applying a product to keratinous fibers comprises a tail having a longitudinal axis X and an application element extending from an end of the tail. A plane containing the axis X may intersect a peripheral edge of each transverse cross-section of at least one longitudinal region of the application element, the plane intersecting the peripheral edge of each cross-section at a first location and a second location. In a first direction along at least a portion of the longitudinal region, a distance from the first location to the axis X may increase and a distance from the second location to the axis X may decrease.

Yet a further optional aspect includes a device for applying a product to keratinous fibers comprising an application element formed from a twisted wire core holding a plurality of bristles. The application element may be configured such that a first location at which a first straight line passing through the twisted wire core intersects a first point on a peripheral edge of a first cross-section of the application element is closer to the core than a second location at which a second straight line, parallel to the first straight line and passing through the twisted wire core, intersects a first point on a peripheral edge of a second cross-section of the application element. The application element may further be configured such that a third location at which the first straight line intersects a second point on the peripheral edge of the first cross-section is farther from the core than a fourth location at which the second straight line intersects a second point on the peripheral edge of the second cross-section.

According to another optional aspect, a device for applying a product to keratinous fibers comprises an application element having a first longitudinal axis, a first transverse cross-section, and a second transverse cross-section. The device further comprises a tail portion extending from a first end of the application element, the tail portion having a first end, a second end, and a second longitudinal axis. The first longitudinal axis and the second longitudinal axis may cross each other at a location within a volume defined by an outer surface of the application element between the first transverse cross-section and the second transverse cross-section. Optionally, the first longitudinal axis and the second longitudinal axis may be skewed with respect to each other. Also optionally, the first longitudinal axis may be in a first plane and the second longitudinal axis may be in a second plane, the first plane and the second plane being parallel to each other.

According to yet another optional aspect of the invention, a device for applying a product to keratinous fibers comprises an application element having a first longitudinal axis, a first transverse cross-section, and a second transverse cross-section. The device further comprises a tail portion extending from a first end of the application element. The tail portion has a first end, a second end, and a second longitudinal axis. The first longitudinal axis and the second longitudinal axis may be non-parallel, or substantially non-parallel, and closest to each other at a location within a volume defined by an outer surface of the application element between the first transverse cross-section and the second transverse cross-section. The location where these two axes are closest to each other may be found by projecting the two axes into a plane and determining their point of intersection. In addition, a line intersecting the first and second non-parallel axes at the location at which the two are closest to each other is orthogonal to both axes. The application element, over at least part of its length, optionally may have a longitudinal axis that substantially coincides with the second longitudinal axis. Again optionally, the first longitudinal axis and the second longitudinal axis may be skewed with respect to each other. Also optionally, the first longitudinal axis may be in a first plane and the second longitudinal axis may be in a second plane, the first plane and the second plane being parallel to each other.

Yet another optional aspect includes a device for applying a product to keratinous fibers, the device comprising an application element comprising a twisted wire core holding a plurality of bristles. A longitudinal axis of at least a portion of the application element extending from a first transverse cross-section to a second transverse cross-section may cross the twisted wire core at a location within a volume defined by an outer surface of the portion of the application element.

Another optional aspect includes a device for applying a product to keratinous fibers, the device comprising an application element comprising a twisted wire core holding a plurality of bristles. A longitudinal axis of at least a portion of the application element extending from a first transverse cross-section to a second transverse cross-section may be closest to the twisted wire core at a location within a volume defined by an outer surface of the portion of the application element. The longitudinal axis and the twisted wire core may be non-parallel, or substantially non-parallel.

According to another optional aspect, a device for applying a product to keratinous fibers comprises an application element and a tail portion extending from a first end of the application element. The tail portion has a first end, a second end, and a longitudinal axis. The longitudinal axis of the tail portion may pass through at least a first transverse cross-section of the application element and a second transverse cross-section of the application element. The longitudinal axis of the tail portion may cross a longitudinal axis of a portion of the application element extending between the first transverse cross-section and the second transverse cross-section at a location within a volume defined by an outer surface of the portion of the application element.

Yet another optional aspect of the invention includes a device for applying a product to keratinous fibers, the device comprising an application element having at least a first face and a second face extending along at least a portion of the length of the application element. The device further comprises a tail portion extending from a first end of the application element, the tail portion having a first end, a second end, and a longitudinal axis. A distance from the first face to the longitudinal axis of the tail portion at a first transverse cross-section of the application element may be greater than a distance from the first face to the longitudinal axis of the tail portion at a second transverse cross-section of the application element. A distance from a second face to the longitudinal axis of the tail portion at the first transverse cross-section of the application element may be less than a distance from the second face to the longitudinal axis of the tail portion at the second transverse cross-section of the application element.

According to yet another optional aspect of the invention, a device for applying a product to keratinous fibers comprises an application element having at least two faces extending along at least a portion of a length of the application element. The device further comprises a tail portion having a first end, a second end, and a longitudinal axis. The first end of the tail portion is connected to the first end of the application element. In a lengthwise direction along at least the portion of the application element, at least one of the at least two faces may converge toward the longitudinal axis of the tail portion and at least another of the at least two faces may diverge away from the longitudinal axis of the tail portion.

In yet another optional aspect, a device for applying a product to keratinous fibers comprises an application element comprising a twisted wire core holding a plurality of bristles. The application element may have at least a first face and a second face extending along at least a portion of the twisted wire core. A distance from the first face to the core at a first transverse cross-section of the application element may be greater than a distance from the first face to the core at a second transverse cross-section of the application element. A distance from a second face to the core at the first transverse cross-section of the application element may be less than a distance from the second face to the longitudinal axis of the core at the second transverse cross-section of the application element.

Yet another optional aspect of the invention includes a device for applying a product to keratinous fibers, the device comprising an application element comprising a twisted wire core holding a plurality of bristles. The application element may have at least two faces extending along at least a portion of the twisted wire core. In a lengthwise direction along at least the portion of the core, at least one of the at least two faces may converge toward the core and at least another of the at least two faces may diverge away from core.

Optionally, the faces of the application element may be plane, concave, or convex. A concave shape may allow the longitudinal edges defining the faces to be more clearly pronounced.

The faces also may be offset angularly with respect to the axis, for example substantially opposite to each other, or may be adjacent adjacent. When the faces are located substantially opposite to each other, a first region, capable of coating the fibers to a maximum extent, may lie diametrically opposite to a second region capable of combing the fibers in an optimal manner. The transition from one region to the other, by moving along the brush, may take place relatively progressively, for example, by following the oblique profile of the first and second faces.

At least a portion of the first face and at least a portion of the second face may extend over substantially the same axial position along the axis X. Also, the first and second faces may extend over substantially the same axial position along the axis X.

The longitudinal edges of the first and second faces may be substantially parallel to each other. Alternatively, they may be non-parallel to each other. For example, they may be convergent and/or divergent curves, over at least part of their length.

The angles $\alpha$ and $\beta$, which optionally are acute, may be identical so that the first and second faces are parallel to each other. This may facilitate use of the device.

Alternatively, the angles $\alpha$ and $\beta$ may differ from each other so that the first and second faces are substantially non-parallel to each other. These parameters, especially relating to the respective angles of the faces, may be adjusted according to factors, such as the desired characteristics at application and/or rheology of the product to be applied.

By way of optional example, angles $\alpha$ and $\beta$ may range from approximately 20° to approximately 15°. Also optionally, the angles α and β may range from approximately 20° to approximately 10° or from approximately 3° to approximately 8°. These angles also may optionally vary according to the length portion of the application element along which the first and second faces extend and/or according to the cross section of the device.

The device according to any of the above-mentioned optional aspects of the invention optionally may comprise at least a third face having two ends which may be in a plane parallel to the axis X. Such a face, which may be oriented substantially parallel to the tail axis of the device, may have a planar, a concave, or a convex profile. The concave or convex regions may be oriented either longitudinally to the axis X or transversely to the axis X.

The application element optionally may be, at least over part of its length, for example, over at least an end part, substantially centered on the axis X. In the case of a device for applying a product to eyelashes, such an end portion may facilitate application of the product to the lower eyelashes or those eyelashes in the corners of the eye. Also optionally, the application element may be substantially symmetrical with respect to the axis of the tail or with respect to a twisted wire core.

The application element may be formed from bristles held by a twisted wire core. The tail portion may be formed from a non-bristled portion of the twisted wire core. The bristles may be made of synthetic fibers, such as made of a polyamide, for example, nylon-6,6, nylon-6,10 or nylon-6, 12, or made of fibers of an elastomer, or the bristles may be made of natural fibers.

Branches of the twisted wire may be twisted about each other to form a helix. The bristles may extend substantially radially outwardly with respect to the core and the turns of the helix may rise from left to right when the application element is observed substantially vertically from the front (left-hand brush). Alternatively, the turns of the helix may rise from right to left when the application element is observed substantially vertically from the front (right-hand brush).

The bristles of the application element may comprise bristles having a hollow cross-section, and/or bristles made of an elastomer, and/or bristles having at least one capillary groove, and/or bristles twisted around their longitudinal axis, to the right or to the left, and/or bristles having ends that have been ground, and/or bristles having ends that form an excrescence, such as in the form of a bead, and/or bristles of various lengths, and/or bristles incorporating fillers, such as bacteriostatic fillers, magnetic fillers or fillers capable of improving slip, and/or flocked bristles, or a mixture of such bristles.

Also optionally, the device may be formed by molding, for example, by molding a thermoplastic. The device optionally may be formed by casting, by machining, or by stamping. The application element may comprise a plurality of application members, such as tines, arranged in at least one row. The tines may have their bases substantially aligned, or at least partly offset alternately on each side of a separating surface. The tines may be arranged such that two successive tines define recesses, for example, V-shaped recesses. These recesses may hold product so as to coat the fibers to be treated in order to lengthen and/or curl them.

At least over part of its length, the application element may be of a substantially regular polygonal cross-section, for example, of triangular, square, rectangular, pentagonal, hexagonal, octagonal, or other similar cross-sections, such as, for example, circular or elliptical. Optionally, the application element may have an irregular polygonal cross-section. The cross-section of the application element may optionally be substantially uniform over at least part of the length of the application element or may optionally be changing over at least part of the length. In the latter case, the cross-section may progressively change.

A longitudinal axis of the application element may be chosen from a straight axis and a curved axis.

The transverse cross-sections of the application element optionally may correspond to the end faces of the application element. Alternatively, the transverse cross-sections of the application element may be taken at any other planes disposed between the two end faces.

In the case of twisted wire brushes, the operation for forming the brushes, and especially for forming the first and second faces, may optionally be carried out by means of a cutting tool. For example, an automatically controlled clipper may be used. The cutting tool may be mounted in line on the industrial tool for manufacturing such an application device. Optioinally, the brush produced in the twisting step may be a cylindrical brush of substantially constant circular cross-section. Depending on the final desired configuration of the brush, the first and second faces may be cut immediately from such a cylindrical brush resulting from the twisting operation. Optionally, an intermediate shaping step may be carried out so as to give the brush an intermediate shape, from which the first and second faces may be cut. Such an intermediate shape may be in the form of a cylinder, a truncated cone, a rugby ball (lozenge), a peanut, a diabolo, or other similar shapes.

According to yet another optional aspect, an applicator may comprise any of the application devices described herein and a stem having a first end connected to the device. For example, the stem may be connected to a tail of the device. The stem may have a second end connected to a handling member. The stem may be integral with or form the gripping element. The stem may lie along the tail axis or the core axis, or make an angle with the tail axis or the core axis. Optionally, the handling member may form a closure element capable of removably closing an opening of a container associated with the applicator.

According to another optional aspect, an assembly for applying a product to keratinous fibers may comprise a container for containing the product. The container may define an opening near which a wiping member may optionally be placed. The assembly may further comprise an applicator according to optional aspects of the invention. The wiping member may comprise an angular lip formed by one edge of a sleeve, for example made of an elastomer. Alternatively, the wiping member may comprise a block of foam, for example an open- or semiopen-cell foam, through which an axial passage or slot passes. The assembly may further comprise product in the container. The product may optionally contain fibers, such as nylon, rayon, cotton or viscose fibers. Such fibers may allow eyelashes to be lengthened further. The application device may be suited to this kind of product in so far as it may make it relatively easy for the fibers to be properly oriented with respect to the application element itself, during the wiping operation, and then with respect to the eyelashes, during application. The length of such fibers may range from approximately 0.2 mm to approximately 2 mm.

Yet another optional aspect of the invention includes a method of applying a product to keratinous fibers. The method may comprise providing an application device according to any of the optional aspects of the invention and loading at least a portion of the application element with a product to be applied to keratinous fibers. The method may further comprise placing at least the loaded portion of the application element in contact with the keratinous fibers to apply the product to the keratinous product.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1A is a schematic illustration of an optional geometrical characteristic of the invention;

FIG. 1B is a first optional embodiment of the application device according to the invention;

FIG. 2 is a second optional embodiment of the application device according to the invention;

FIG. 3 is a third optional embodiment of the application device according to the invention;

FIG. 4A is a fourth optional embodiment of the application device according to the invention;

FIG. 4B is a cross-sectional view of the application device of FIG. 4 taken long line 4B—4B;

FIG. 4C is a cross-sectional view of the application device of FIG. 4 taken along line 4C—4C;

Figure 5:
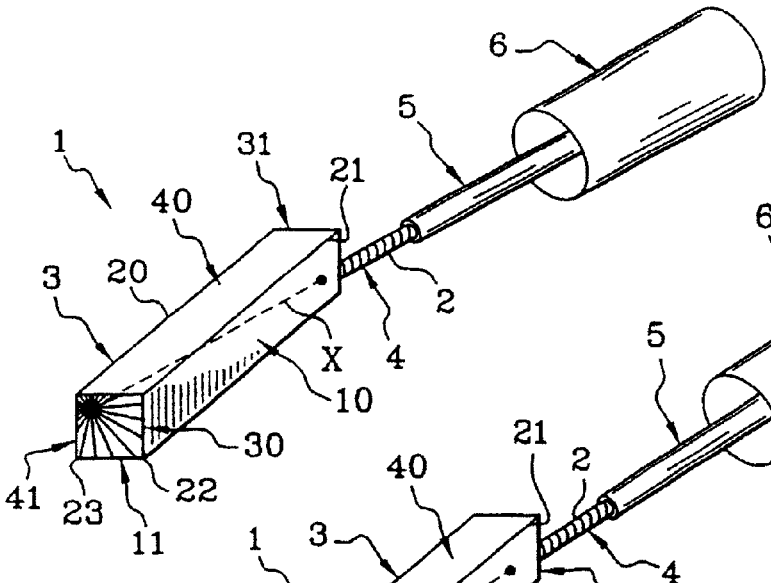
FIG. 5 is a fifth optional embodiment of the application device according to the invention.

FIG. 1A shows schematically various optional characteristics of the present invention. Many of these characteristics are contained in other embodiments shown in the remainder of the drawings, but may not be specifically discussed with respect to each embodiment. FIG. 1A shows an application device 1 of square cross-section and having an application element 3. The axis X of the tail 4 of the device 3 makes an acute angle $\beta$ with a face 10 of the brush. The vertex of the angle $\beta$ may be turned toward the tail 4. The axis X of the tail 4 of the brush 1 may form an angle $\alpha$ with a face 40 of the brush. The face 40 is located substantially opposite the face 10. The vertex of the angle $\alpha$ may be turned away from the tail 4. The angles $\alpha$ and $\beta$ may be approximately equal, such as, for example, about 5°, so that the faces 10 and 40 are approximately parallel. The other two longitudinal faces, not referenced, may be parallel to each other and parallel to the axis X of the tail 4. In the rest of the description, by convention a reference numeral starting with the number "1" will denote the faces making an angle of the "$\beta$" type with the axis X and the vertex of which is turned toward the tail 4. A reference numeral starting with the number "4" will denote the faces making an angle of the "$\alpha$" type with the axis X and the vertex of which is turned away from the tail 4. A reference numeral starting with the number "5" will denote the faces whose two ends lie in a plane substantially parallel to the axis X.

As shown in FIG. 1A, the longitudinal axis X' of the application element 3, crosses the axis X at a point within a volume defined by the outer surface of the application element 3. Further, the distance between the face 40 and the axis X increases in a direction toward the tail 4, while the distance between the face 10 and the axis X (i.e., the twisted wire core in this optional embodiment) decreases in a direction toward the tail 4. In other words, along the axis X in a direction toward the tail 4, the face 40 diverges away from the axis X and the face 10 converges toward the axis X.

The axis X shown in FIG. 1B also may coincide with the twisted wire core of the application element 3 when the application device 1 is of the twisted wire type of brush.

The device 1 shown in FIG. 1B comprises of a twisted wire brush, of the "right-hand brush" type. The turns of the helix formed by the twisted wire branches 2 rise from right to left when the brush is observed vertically from the front. The brush comprises an application element 3, formed from a bristled portion of the wire 2, and a tail 4 formed from a non-bristled portion of the wire 2. The portion of the wire 2 holding the bristles is referred to herein as the twisted wire core of the application element. One end of the tail 4 may be integral with the free end of a stem 5. The end of the stem 5 opposite to the tail 4 may be connected to a handling member 6 capable, as will be seen in greater detail below, of forming a closure element to close off the opening of a container with which the device is intended to be associated.

The application element 3 may be of triangular cross-section over some of or the entire length of the brush 1. It may comprise a first face 10 bounded by the longitudinal edges 20 and 21. A second face 40 may be bounded by the longitudinal edges 21 and 22. A third face 41 may be bounded by the longitudinal edges 22 and 20. The axis X corresponding to the axis of the tail 4 passes through the end face 30 at a point lying near the vertex defined by the faces 40 and 41. It also passes through the end face 31, opposite the face 30, near the face 10, approximately in the middle of it.

Thus, the face 10 may make an acute angle with the axis X, the vertex of which is turned toward the tail 4. The faces 40 and 41 may make an acute angle with the axis X, the vertex of which is turned toward the end face 30.

In order to make the tail 4 of the brush 1 visible in the figures, the brush 1 has been shown in the position in which it is only partially fitted into the stem 5. In practice, the engagement between the tail 4 of the brush 1 and the stem 5 is such that the stem is substantially in contact with the application element 3. The face 10 of the brush 1 is cut in such a way that, at the junction between the stem 5 and the application element 3, the shortest bristles of the face 10 are approximately at the same level as the lateral surface of the stem 5.

In the optional embodiment shown in FIG. 2, the brush 1 is of triangular cross-section with three slightly concave faces 13, 43, and 50. The face 13 may be bounded by the edges 20 and 21. The face 43 may be bounded by the edges 21 and 22, and the face 50 may be bounded by the edges 22 and 20. The axis X corresponding to the axis of the tail 4 may pass through the end face 30 at a point lying near the vertex defined by the faces 43 and 50. It also may pass through the end face 31, opposite the face 30, at a point lying near the vertex defined by the faces 13 and 50.

Thus, the face 13 may make an acute angle with the axis X, the vertex of which may be turned toward the tail 4. The face 43 may make an acute angle with the axis X, the vertex of which may be turned toward the end face 30. The face 50 may be parallel to the axis X.

In the optional embodiment shown in FIG. 3, the application element 3 has a generally triangular cross section, approximately in the form of an isosceles triangle, and is bounded by two end faces 30 and 31. The end faces 30 and 31 are joined by edges joining, in pairs, the corners of the face 30 to the vertices of the face 31, and vice versa. Thus, the edges 20–23 may define a first group of faces 44, 51, and 52, having a width decreasing toward the end face 31, and a second face 14 having a width decreasing toward the end face 30. The end face 30 may be substantially oriented opposite the end face 31. The vertex of the isosceles triangle formed by the face 30 may be opposite the base of the isosceles triangle formed by the face 31, and vice versa. The axis X corresponding to the axis of the tail 4 may pass through the end face 30 near the face 44, approximately in the middle of it, and may pass through the end face 31 near the face 14, approximately in the middle of it. Thus, the face 14 may make an acute angle with the axis X, the vertex of which may be turned toward the tail 4. The face 44 may make an acute angle with the axis X, the vertex of which is turned towards the end face 30. The faces 51 and 52 may be parallel to the axis X. The device according to this optional embodiment comprises certain faces which, intentionally, have not been shown for the sake of clarity of the presentation.

In the optional embodiment shown in FIGS. 4A–4C, the application element 3 comprises a main portion 32 and an end portion 33. The main portion 32 may be of triangular cross-section, having a progressively decreasing area in the direction away from the tail 4. The triangular cross-section may have three edges 20, 21, and 22 defining three faces 14, 44, and 51. The main portion 32 of the application element 3 may be bounded by two transverse cross-sections, one transverse cross-section 31 may comprise an end face of the application element 3 adjacent to the tail 4, and the other transverse cross-section 30 may be at a junction between the main portion 32 and an end portion 33 of the application element 3. The axis X, corresponding to the axis of the tail 4, may pass through the end face 30 at a point lying near the vertex defined by the faces 44 and 51 and may pass through the end face 31 at a point lying near the vertex defined by the faces 14 and 51.

Thus, the face 14 may make an acute angle with the axis X, the vertex of which may be turned toward the tail 4. The face 44 may make an acute angle with the axis X, the vertex of which may be turned toward the end face 30. The face 51 may be substantially parallel to the axis X.

The end portion 33 having a cross-section decreasing towards the free end of the application element 3, may be used for applying make-up to the lower eyelashes and those eyelashes in the corners of the eye. The face 51 may run continuously, with substantially the same inclination, over both the main portion 32 and over the end portion 33.

In the optional embodiment shown in FIG. 5, the application element is of square cross-section and has four longitudinal edges 20, 21, 22, and 23. The four edges 20–23 define four faces 10, 11, 40, and 41. The face 40 may be bounded by the edges 20, 21, and the face 10 may be bounded by the edges 21, 22. The face 11 may be bounded by the edges 22, 23, and the face 41 may be bounded by the edges 23, 20.

The axis X corresponding to the axis of the tail 4 may pass through the end face 30 at a point lying near the angle defined by the faces 40 and 41 and may pass through the end face 31 at a point lying near the angle defined by the faces 10 and 11. Thus, the faces 10 and 11 may make an acute angle with the axis X, the vertex of which may be turned toward the tail 4. The faces 40, 41 may make an acute angle with the axis X, the vertex of which may be turned toward the end face 30.

In other words, according to this optional embodiment, each face making an angle of the "α" type is opposite a face making an angle of the "β" type, and vice versa. Likewise, each face making an angle of the "α" type is flanked both by a face making an angle of the "β" type and by a face making an angle of the "α" type. The same applies for each face making an angle of the "β" type.

Figure 6:
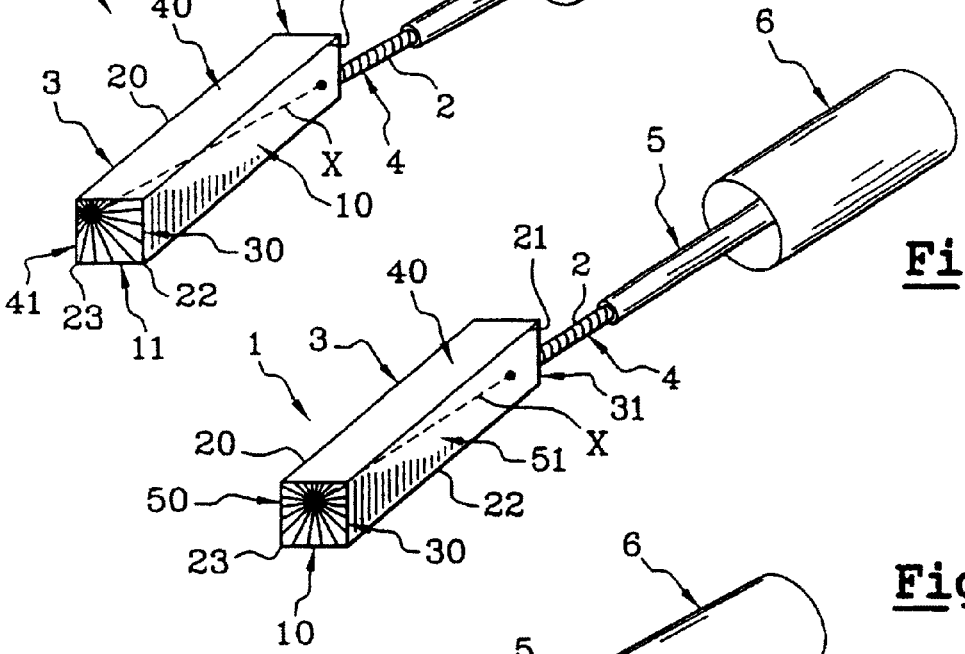
FIG. 6 is a sixth optional embodiment of the application device according to the invention.

In the optional embodiment shown in FIG. 6, the application element may be of square cross-section and may have four longitudinal edges 20, 21, 22, 23. The four edges 20–23 may define four faces, which may be substantially parallel in pairs. A face 40 may be bounded by the edges 20, 21, a face 51 may be bounded by the edges 21, 22, a face 10 may be bounded by the edges 22, 23, and a face 50 may be bounded by the edges 23, 20.

The axis X corresponding to the axis of the tail 4 may pass through the end face 30 at a point lying near the face 40, approximately in the middle of it, and may pass through the end face 31 at a point lying near the face 10, approximately in the middle of it. Thus, the face 10 may make an acute angle with the axis X, the vertex of which is turned toward the tail 4. The face 40, located opposite the face 10, may make an acute angle with the axis X, the vertex of which may be turned toward the end face 30. The faces 50 and 51 may be parallel to each other and parallel to the axis X.

Figure 7:
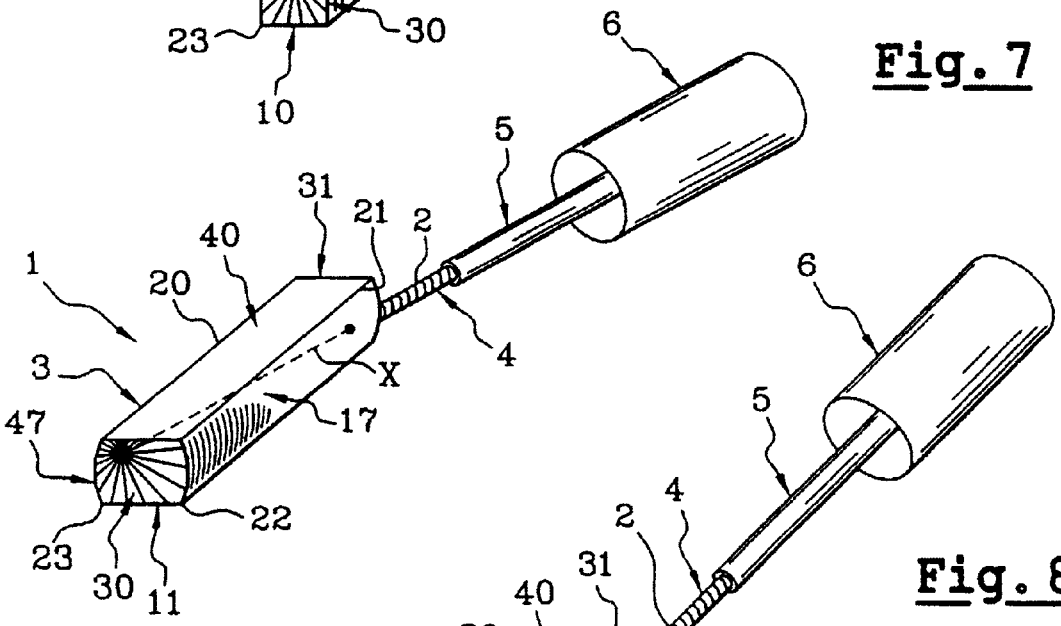
FIG. 7 is a seventh optional embodiment of the application device according to the invention.

The optional embodiment shown in FIG. 7 is of similar configuration as the embodiment of FIG. 5. However, the embodiment of FIG. 7 differs from that of FIG. 5 in that the faces 17 and 47, corresponding to the faces 10 and 41 of the optional embodiment shown in FIG. 5, are convex as opposed to planar. The convexity of the faces 17 and 47 may be oriented along an axis substantially parallel to the straight edges 20–23.

Figure 8:
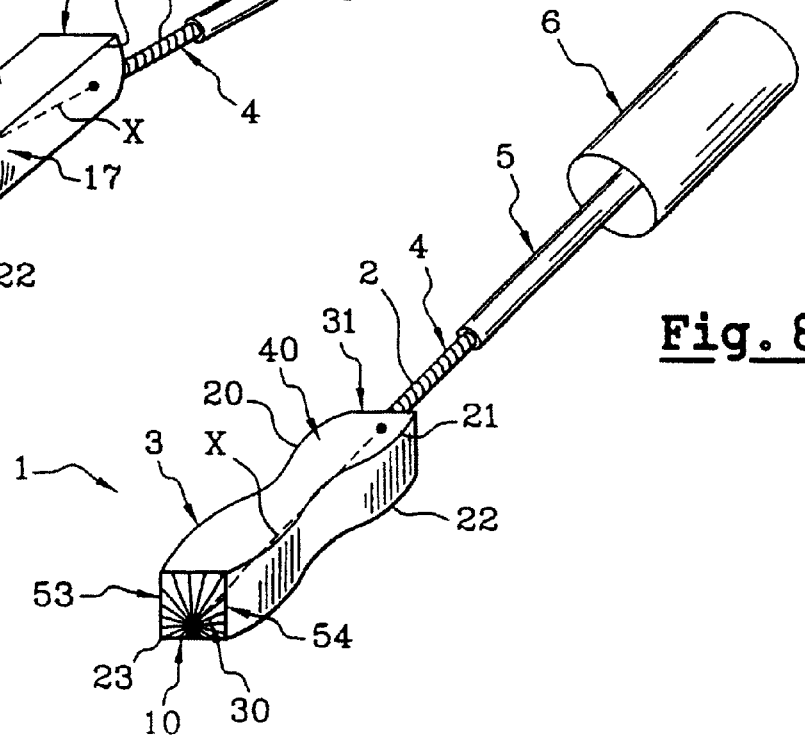
FIG. 8 is a eighth optional embodiment of the application device according to the invention.

The optional embodiment shown in FIG. 8 may be similar to the optional embodiment of FIG. 6, but may differ that embodiment in that the faces 53 and 54, corresponding to the faces 50 and 51 of the optional embodiment shown in FIG. 6 may form a wave-like structure whose trough lies approximately at the middle of the application element 3. The edges 20–23 may not be straight and may have a profile substantially similar to that of the faces 53, 54. Such a brush may be obtained from an initial brush whose shape may be substantially similar to the shape of a peanut.

Figure 9A:
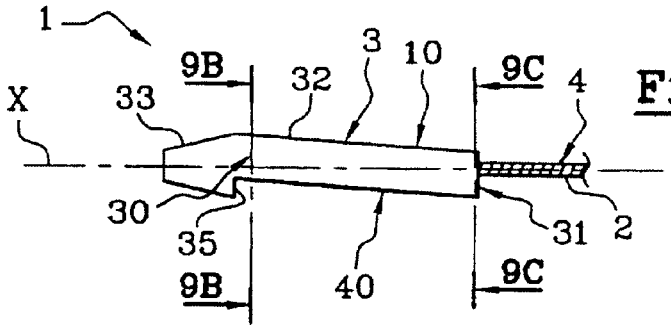
FIG. 9A is a ninth optional embodiment of the application device according to the invention.
Figure 9B:
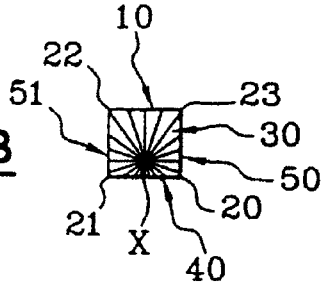
FIG. 9B is a cross-sectional view of the application device of FIG. 9 taken along line 9B—9B.
Figure 9C:
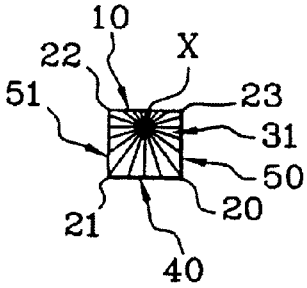
FIG. 9C is a cross-sectional view of the application device of FIG. 9 taken along line 9C—9C.

The optional embodiment shown in FIGS. 9A–9C differs from the optional embodiment shown in FIG. 6 in that the application element 3 comprises a main portion 32, which may be substantially identical to the application element 3 of the optional embodiment shown in FIG. 6, and an end portion 33 extending from the main portion 32. The end portion 33 may form a truncated cone intended to make it easier to apply make-up to the lower eyelashes and to those eyelashes in the corners of the eye. A shoulder 35 may be formed at the junction between the main portion 32 and the end portion 33.

FIGS. 9B and 9C show the approximate location of the intersection of the axis X with the cross-sectional portions 30, 31 of the brush located at lines 9B—9B and 9C—9C, respectively.

Furthermore, unlike the previous optional embodiments in which the brushes were all "right-hand brushes", the application device 1 in this optional embodiment is a "left-hand brush" since the turns of the helix formed by the twisted wire branches 2 rise from the left to the right when the brush is observed substantially vertically from the front.

Figure 10A:
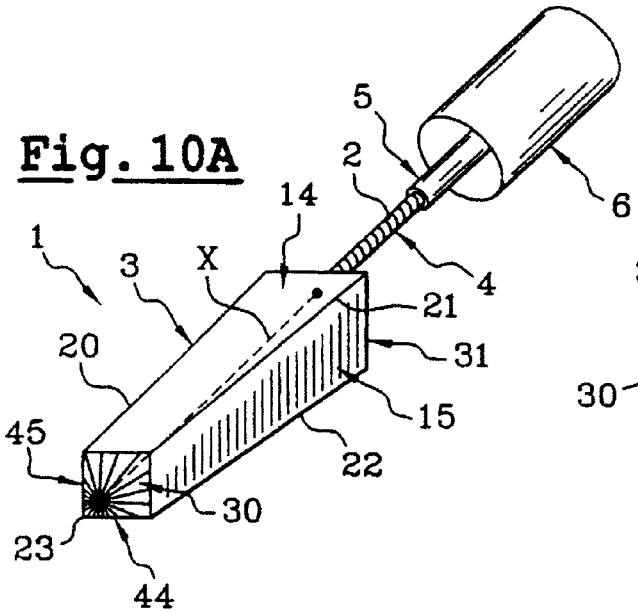
FIG. 10A is a tenth optional embodiment of the application device according to the invention.
Figure 10B:
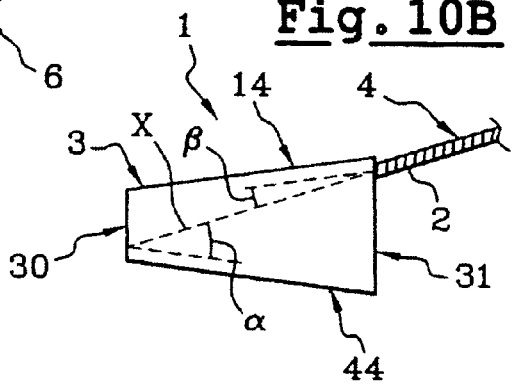
FIG. 10B is a side view of the device shown in FIG. 10A.

In the optional embodiment shown in FIGS. 10A and 10B, the brush is again of the "right-hand" type. The application element 3 is of frustoconical cross-section and has four longitudinal edges 20, 21, 22, and 23. The four edges 20–23 define four faces. A face 14 is bounded by the edges 20, 21. A face 15, adjacent to the face 14, is bounded by the edges 21, 22. A face 44, located opposite the face 14, is bounded by the edges 22, 23, and a face 45, located opposite the face 15, is bounded by the edges 23, 20.

The axis X corresponding to the longitudinal axis of the tail 4 passes through the end face 30 at a point lying near the angle defined by the faces 44 and 45. The axis X also passes through the end face 31 at a point lying near the face 14, approximately in the middle of it. Thus, the faces 14 and 15 make an acute angle with the axis X, the vertex of which may be turned toward the tail 4. The angles made by these two faces with the axis X may be substantially identical or may differ. The faces 44 and 45 may make an acute angle with the axis X, the vertex of which may be turned toward the end face 30. As is apparent in the schematic view shown in FIG. 10B, the angle $\beta$ made between the face 14 and the axis X may be less than the angle $\alpha$ made between the face 44 and the axis X due to the frustoconical shape of the application element 3.

Figure 11:
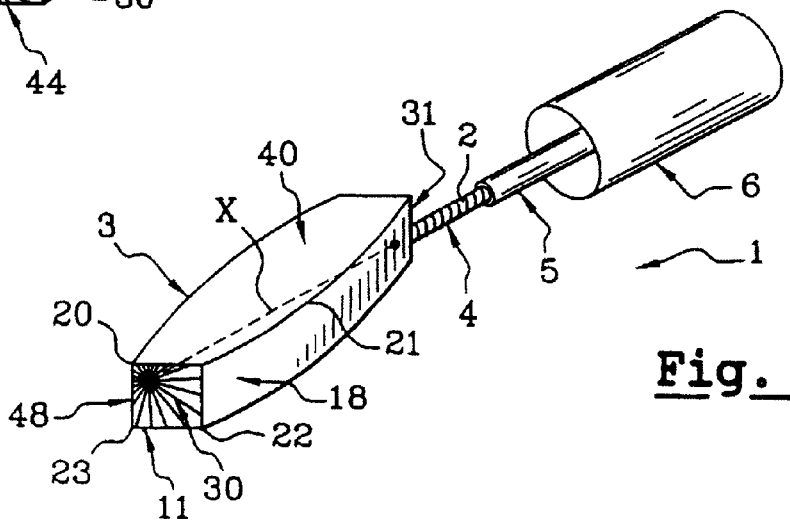
FIG. 11 is a eleventh optional embodiment of the application device according to the invention.

The brush 1 of the optional embodiment shown in FIG. 11 is similar to the optional embodiment of FIG. 5, but differs from that embodiment in that the faces 18 and 48, corresponding to the faces 10 and 41 of the embodiment shown in FIG. 5, have a convex configuration rather than a planar configuration. The faces 18 and 48 have a substantially constant width, whereas the faces 11 and 40 have a width passing through a maximum approximately at the middle of the application element 3. Just as in the optional embodiment shown in FIG. 5, the faces 11 and 18 may make an acute angle with the axis X, the vertex of which may be turned toward the tail 4. The faces 40, 48 may make an acute angle with respect to the axis X, the vertex of which may be turned toward the end face 30.

Figure 12A:
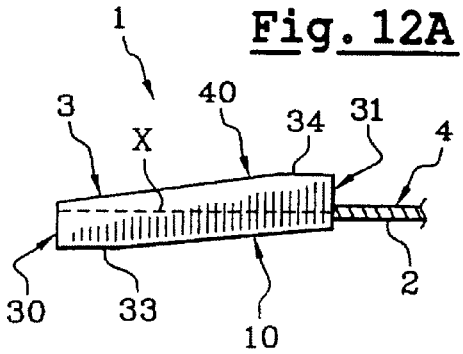
FIG. 12A is a twelfth optional embodiment of the application device according to the invention.
Figure 12B:
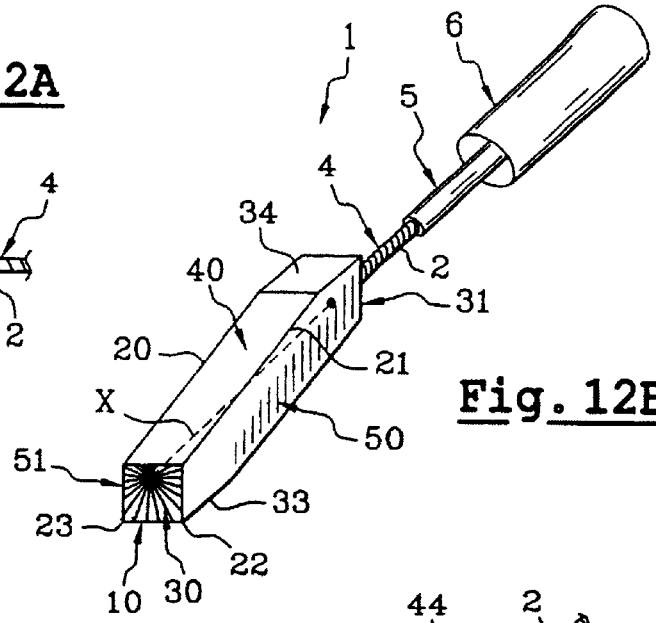
FIG. 12B is a perspective view of the application device shown in FIG. 12A.

In the optional embodiment shown in FIGS. 12A and 12B, the brush is of the "left-hand" type and is of rectangular cross-section progressively varying between the square cross-section of the end face 30 and the square cross-section of the end face 31.

The application element 3 has four longitudinal edges 20, 21, 22, and 23. The four edges 20–23 may define four faces. A face 40 may be bounded by the edges 20, 21. Over a major part of its length, the face 40 may be oblique with respect to the axis X and may terminate in an end portion 34. The end portion 34 may be parallel to the axis X and adjacent to the end face 31 of the application element 3. A face 10, located substantially opposite to the face 40, may be bounded by the longitudinal edges 22, 23. Over a major part of its length the face 10 may be oblique with respect to the axis X and may terminate in an end portion 33. The end portion 33 may be located at a substantially opposite end of the application element 3 as end portion 34. The end portion 33 may be parallel to the axis X and adjacent to the end face 30 of the application element 3. A face 50 may be bounded by the edges 21, 22 and a face 51 may be bounded by the edges 23, 20. The faces 50 and 51 vary in width and be parallel to the axis X.

Thus, the face 10 may make, over the major part of the length of the brush 1, an acute angle with the axis X, the vertex of which may be turned toward the tail 4. The face 40 may make, over the major part of the length of the brush 1, an acute angle with respect to the axis X, the vertex of which may be turned toward the end face 30. The faces 50 and 51 may be parallel to each other and parallel to the axis X. The oblique portions of the faces 10 and 40 may be offset axially by a length corresponding to the length of the end portions 33 and 34, but may overlap over the major part of their length. The end part 33 and 34 may make it easier to apply the make-up to the lower eyelashes and to those in the corner of the eyes.

Figure 13:
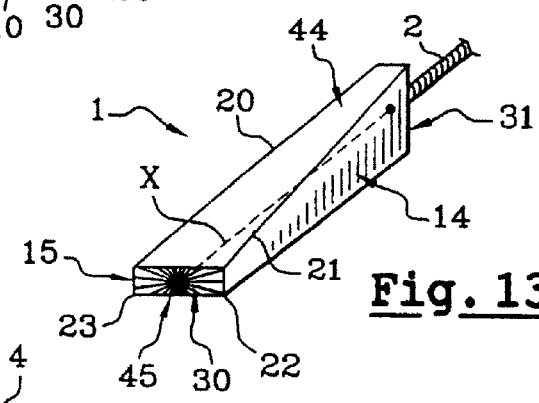
FIG. 13 is a thirteenth optional embodiment of the application device according to the invention.
Figure 14A:
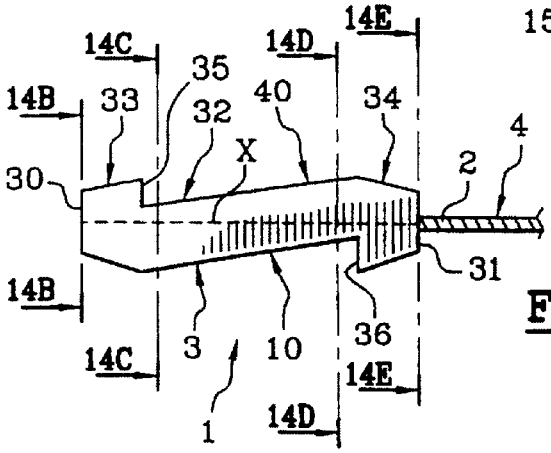
FIG. 14A is a fourteenth optional embodiment of the application device according to the invention.
Figure 14B:
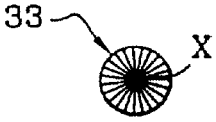
FIG. 14B is a cross-sectional view of the application device of FIG. 14A taken from line 14B—14B.
Figure 14C:
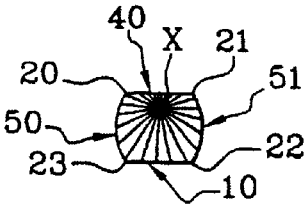
FIG. 14C is a cross-sectional view of the application device of FIG. 14A taken from line 14C—14C.
Figure 14D:
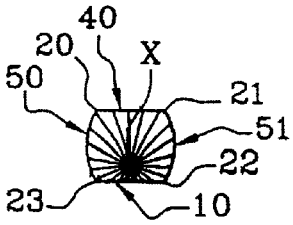
FIG. 14D is a cross-sectional view of the application device of FIG. 14A taken from line 14D—14D.
Figure 14E:
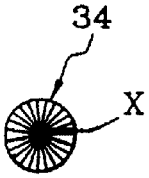
FIG. 14E is a cross-sectional view of the application device of FIG. 14A taken from line 14E—14E.

In the optional embodiment shown in FIG. 13, the brush is of the "righthand brush" type, having a rectangular cross-section and four longitudinal edges 20–23. The rectangle formed by the end face 30 may be offset at 90° to the rectangle formed by the end face 31. This may permit the straight edges 20–23 to join, in pairs, the long sides of the rectangle formed by the end face 30 to the short sides of the rectangle formed by the end face 31, and vice versa.

A face 44 may be bounded by the edges 20, 21. A face 14, adjacent to the face 44, may be bounded by the edges 21, 22. A face 45, located substantially opposite the face 44, may be bounded by the edges 22, 23. A face 15, located substantially opposite the face 14, may be bounded by the edges 23 and 20.

The axis X corresponding to the axis of the tail 4 may pass through the end face 30 at a point lying approximately at its center and may pass through the end face 31 at a point lying approximately at its center.

Thus, the faces 14 and 15 may make an acute angle with the axis X, the vertex of which may be turned toward the tail 4. The faces 44 and 45 may make an acute angle with the axis X, the vertex of which may be turned toward the end face 30. As is apparent from the above description, according to this optional embodiment, the faces oriented at an angle $\alpha$ are adjacent to the faces oriented at an angle $\beta$.

In the optional embodiment shown in FIGS. 14A–14E, the device 1 is distinguished from the optional embodiment shown in FIGS. 9A–9C in that a truncated cone 34 is also formed near that end of the application element 3 adjacent to the tail 4. The truncated cone 34 may be separated from the main portion 32 of the application element 3 by a shoulder 36, which may be diametrically opposed to the shoulder 35 formed near the other end of the application element 3. Furthermore, the two faces 50, 51 parallel to the axis X may be convex in shape, in the manner of the faces 17 and 47 of the optional embodiment shown in FIG. 7.

In the main part 32 of the application element 3, the face 10 may make an angle with the axis X, the vertex of which may be turned toward the tail 4. The face 40 may make an acute angle with the axis X, the vertex of which may be turned toward the end face 30. According to this embodiment, the face 40, oriented at an angle $\alpha$, is opposite the face 10, oriented at an angle $\beta$. The faces 50 and 51, located substantially opposite to each other, may have an overall orientation substantially parallel to the axis X. In this optional embodiment, as in the case of the embodiment shown in FIGS. 9A–9C, the brush 1 is of the "left-hand brush" type.

Figure 15:
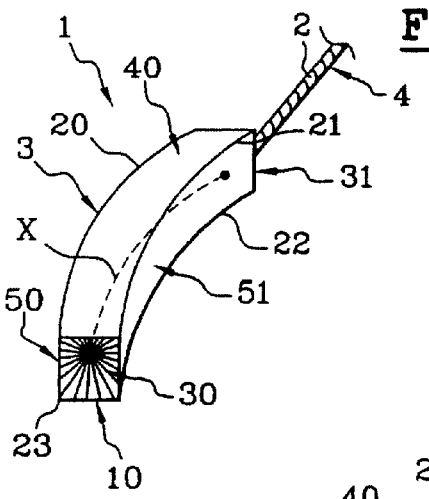
FIG. 15 is a fifteenth optional embodiment of the application device according to the invention.

The optional embodiment shown in FIG. 15 may be distinguished from the optional embodiment shown in FIG. 6 in that the core of the brush formed by the twisted wire 2 is curved over the length of the applicator portion 3. As in the case of the embodiment shown in FIG. 6, the face 10 may make an acute angle with the curved axis X, the vertex of which may be turned toward the tail 4. The face 40 may make an acute angle with the curved axis X, the vertex of which may be turned toward the end face 30. The faces 50 and 51 may be substantially parallel to each other and may follow the curve of the axis X.

Figure 16:
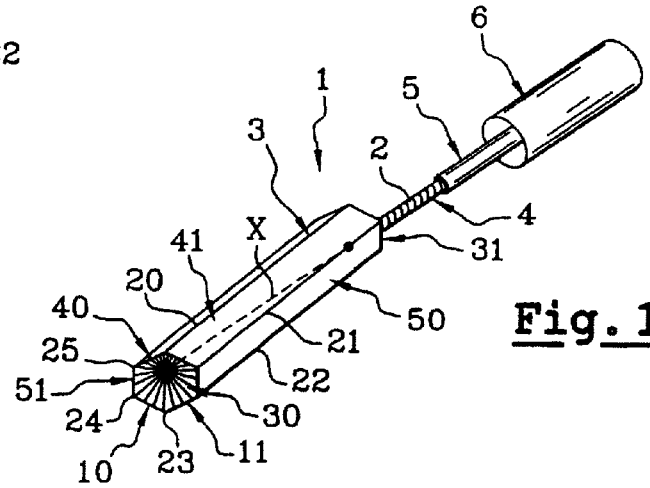
FIG. 16 is a sixteenth optional embodiment of the application device according to the invention.

In the optional embodiment shown in FIG. 16, the application element may have a hexagonal cross-section. The application element 3 may have six longitudinal edges 20–25 defining six faces. A face 40 may be bounded by the edges 25 and 20. A face 41 may be bounded by the edges 20 and 21. A face 50 may be bounded by the edges 21 and 22. A face 11 may be bounded by the edges 22 and 23. A face 10 may be bounded by the edges 23 and 24. A face 51 may be bounded by the edges 24 and 25.

The axis X corresponding to the axis of the tail 4 may pass through the end face 30 at a point lying near the vertex defined by the faces 40 and 41 and may pass through the end face 31 at a point lying near the angle defined by the faces 10 and 11.

Thus, the faces 10 and 11 may make an acute angle with the axis X, the vertex of which may be turned toward the tail 4. The faces 40 and 41 may make an acute angle with the axis X, the vertex of which may be turned towards the end face 30. The faces 50 and 51 may be parallel to the axis X.

With regard to FIGS. 17A–17F, to which reference will now be made, these figures illustrate certain optional bristle configurations that can be used for producing an applicator device 1 as described with reference to the various optional embodiments that have just been illustrated.

Figure 17A:
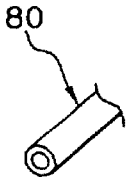
FIG. 17A is a partial perspective view of an optional bristle configuration that may be used in the various embodiments according to the invention.

FIG. 17A shows a bristle 80 having a tubular cross-section.

Figure 17B:
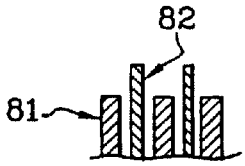
FIG. 17B is a partial perspective view of another optional configuration for bristles that may be used in the various embodiments according to the invention.

FIG. 17B shows an arrangement of relatively short large-diameter bristles 81 and relatively long small-diameter bristles 82. Such an arrangement may be obtained by grinding a brush formed from a mixture of large-diameter bristles and small-diameter bristles. The bristles of relatively small cross-section may be inclined when they engage with the clipper, and are therefore slightly shortened, whereas the relatively large-diameter bristles may remain substantially straight when they engage with the clipper, and are therefore shortened to an even greater extent.

Figure 17C:
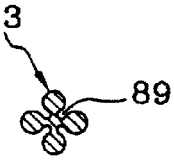
FIG. 17C is a cross-sectional view of another optional bristle configuration that may be used in the various embodiments according to the invention.

In FIG. 17C, a bristle 83 comprising a plurality of grooves 89 is shown. These grooves 89 may be capable of retaining product by capillary effect and may extend over all or part of the length of the bristle.

Figure 17D:
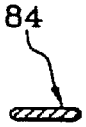
FIG. 17D is a cross-sectional view of yet another optional bristle configuration that may be used in the various embodiments according to the invention.

In FIG. 17D, the bristle 84 is of substantially elongate cross-section. Its cross-section may be solid or hollow.

Figure 17E:
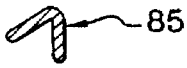
FIG. 17E is a cross-sectional view of yet another optional bristle configuration that may be used in the various embodiments according to the invention.

In FIG. 17E, the cross-section of the bristle 85 is in the form of a boomerang type configuration.

Figure 17F:
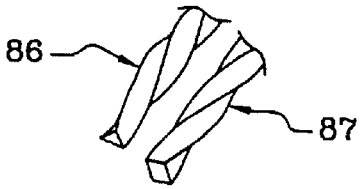
FIG. 17F is a partial perspective view of yet other optional bristle configurations that may be used in the various embodiments according to the invention.

FIG. 17F shows a bristle 87 twisted around its longitudinal axis in a first direction of twisting and a bristle 88 twisted around its longitudinal axis in a second direction of twisting, opposite to the first. A mixture of bristles 87 and 88 may be used in the application element or, alternatively, all bristles may be of the same twist type.

Figure 17G:
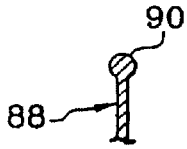
FIG. 17G is a cross-sectional view of another optional bristle configuration that may be used in the various embodiments according to the invention.

In FIG. 17G, the bristle 88 forms at its end a bead 90, which may be formed from a thermal or mechanical treatment.

Figure 18:
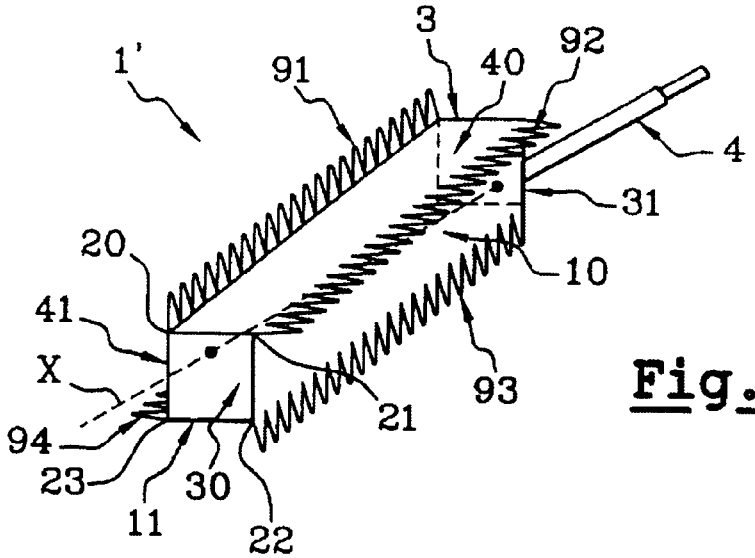
FIG. 18 is a seventeenth optional embodiment of the application device according to the invention.

In the optional embodiment shown in FIG. 18, the brush 1' is obtained by molding a thermoplastic. The application element 3 may have a square cross-section and four longitudinal edges 20, 21, 22, and 23. The four edges 20–23 define four faces. For example, a face 40 may be bounded by the edges 20, 21, a face 10 may be bounded by the edges 21, 22, a face 11 may be bounded by the edges 22, 23 and a face 41 may be bounded by the edges 23, 20.

The axis X corresponding to the axis of the tail 4 may pass through the end face 30 at a point lying near the face 40, approximately in the middle of it, and also may pass through the end face 31 at a point lying near the angle defined by the faces 10 and 11.

Thus, the faces 10 and 11 may make an acute angle with the axis X, the vertex of which may be turned toward the tail 4. The faces 40, 41 may make an acute angle with the axis X, the vertex of which may be turned toward the end face 30. Each of the faces 10, 11, 40, 41 may be extended, approximately in its plane, by a row of tines 91–94 which may be capable of applying product to the fibers to be treated. The rows of tines 91–94 may be oriented, in pairs, at 90° with respect to one another, in the same rotation direction. The tail 4 of the brush 10 may be formed by molding with the application element of the brush.

It is obvious that the variants that may be made to the embodiments that have just been described are numerous, simply by changing the relative combinations of the first, second and possibly third faces. Each combination, in association with a product of given rheology and in association with a given arrangement of the bristles or tines which form it, generates application characteristics which each time may be different.

Figure 19:
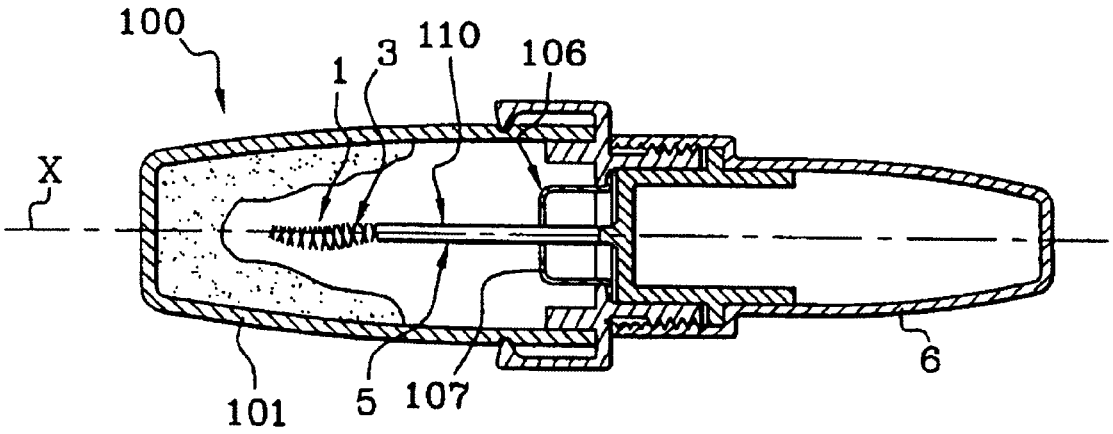
FIG. 19 is an assembly equipped with an application device according to the invention.

FIG. 19 shows an application assembly 100 equipped with an application device 1, which may have any of the optional configurations according to the invention. The assembly 100 comprises a container 101 configured to contain a cosmetic, care, or other product, such as, for example, mascara. The assembly comprises an applicator 110. The applicator 110 comprises an application device 1, which may optionally be of the twisted-brush type or may be molded. The application device is connected to one end of a stem 5 of axis X. The other end of the stem 5 may be connected to or integral with a handling member 6. The handling member 6 may also constitute a cap for closing the container 101. The container 101 may include a wiping member 106. The wiping member 106 may be in the form of a cylindrical sleeve, one end of which terminates in a flexible annular lip 107. In the position in which the applicator 110 is mounted on the container 101, the applicator device 1 lies entirely between the wiping lip 107 and the bottom of the container. Other types of wiping members also may be used, such as, for example, a block of open- or semiopen-cell foam penetrated axially by a slot or passage, whose edges defining it are practically touching when no stress is applied, or other similar suitable wiping members.

For the purpose of using the applicator, a user may unscrew the cap formed by the handling member 6 and extract the applicator 110 from the container 101. Having done this, the applicator device 1 may pass through the wiping member 106 so as to meter the amount of product distributed on the tines or bristles, for example, by wiping excess product from the application element 1. The movement to extract the applicator may be along a direction substantially longitudinal to the axis X. After use, the user may put the applicator back into the container, again making the applicator device 1 pass through the wiping member 106. Due to the configuration of the application element 3, the wiping member 106 may wipe different amounts of product from the application element 3 depending upon the angular position of the application element.

Figure 20A:
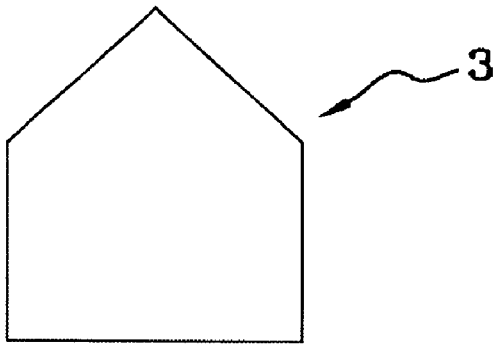
FIG. 20A is a cross-sectional view of an optional embodiment of an application element according to the invention.
Figure 20B:
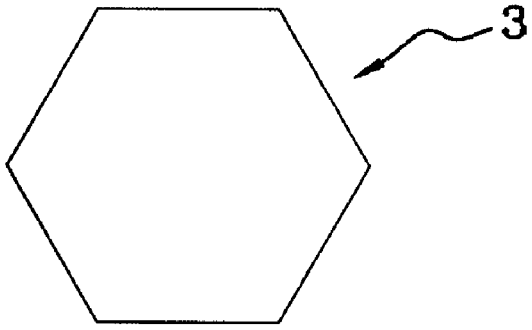
FIG. 20B is a cross-sectional view of another optional embodiment of an application element according to the invention.

FIG. 20A shows cross-section of an optional embodiment of an application element 3. In this embodiment, the application element has a pentagonal cross-section. FIG. 20B shows a cross-section of an optional embodiment of an application element 3 having an octagonal cross-section.

Although many of the embodiments shown and discussed in the figures referred to twisted wire type of application devices, it is contemplated as within the scope of the invention that any of the application devices may be molded or otherwise formed as described herein. Moreover, sizes of various structural parts and materials used to make these parts are illustrative and exemplary only and one of ordinary skill in the art would recognize that these sizes and materials can be changed as necessary to produce different effects or desired characteristics of the application device.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product to keratinous fibers, the device comprising:

a tail having a longitudinal axis X; and an application element extending from an end of the tail, the application element comprising at least a first face and a second face, each of the faces being delimited by two longitudinal edges and extending over at least part of a length of the application element, wherein the first face forms with the axis X a first non-zero angle $\alpha$ having a vertex oriented toward a first end of the application element, and wherein the second face forms with the axis X a second non-zero angle $\beta$ having a vertex oriented toward a second end of the application element, the second end being opposite to the first end.

2. The device of claim 1, wherein the application element further comprises a first cross-sectional portion and a second cross-sectional portion, the first and second cross-sectional portions being disposed substantially transverse to the axis X, and wherein the first and second faces extend between the first and second cross-sectional portions, the axis X intersecting the first and second cross-sectional portions.

3. The device of claim 1, wherein the first face and the second face are one of planar and concave.

4. The device of claim 1, wherein at least a portion of the first face and at least a portion of the second face extend over substantially the same axial position along the axis X.

5. The device of claim 4, wherein the first face and the second face extend over substantially the same axial position along the axis X.

6. The device of claim 1, wherein the two longitudinal edges delimiting each of the at least the first and second faces are substantially parallel to each other.

7. The device of claim 1, wherein the two longitudinal edges delimiting each of the at least the first and second faces are substantially non-parallel to each other.

8. The device of claim 7, wherein the two longitudinal edges delimiting each of the at least the first and second faces substantially one of converge toward each other and diverge away from each other over at least part of their length.

9. The device of claim 1, wherein the angles $\alpha$ and $\beta$ are substantially identical to each other such that the first face and the second face are substantially parallel to each other.

10. The device of claim 1, wherein the angles $\alpha$ and $\beta$ substantially differ from each other such that the first face and the second face are substantially non-parallel to each other.

11. The device of claim 1, wherein the angles $\alpha$ and $\beta$ range from approximately 2° to approximately 15°.

12. The device of claim 1, wherein the angles $\alpha$ and $\beta$ range from approximately 2° to approximately 10°.

13. The device of claim 1, wherein the angles $\alpha$ and $\beta$ range from approximately 3° to approximately 8°.

14. The device of claim 1, wherein the first face and the second face are disposed substantially opposite to each other.

15. The device of claim 1, wherein the first face and the second face are adjacent to each other.

16. The device of claim 1, wherein the application element further comprises a third face having two ends in a plane substantially parallel to the axis X.

17. The device of claim 16, wherein the third face is one of planar, concave, and convex.

18. The device of claim 1, wherein the application element, over at least part of its length, is substantially centered with respect to the axis X.

19. The device of claim 1, wherein the application element, over at least part of its length, is substantially symmetric with respect to the axis X.

20. The device of claim 1, wherein the application element further comprises a plurality of bristles held by a twisted wire core, and wherein said tail is formed from a non-bristled portion of said twisted wire core.

21. The device of claim 20, wherein the twisted wire core comprises wire branches twisted to form a helix around a longitudinal axis of the core, the bristles extending radially with respect to the core and turns of the helix rising from left to right when the device is observed substantially vertically from a front of the device.

22. The device of claim 20, wherein the twisted wire core comprises wire branches twisted to form a helix around a longitudinal axis of the core, the bristles extending radially with respect to the core and turns of the helix rising from right to left when the device is observed substantially vertically from a front of the device.

23. The device of claim 20, wherein at least some of the bristles of the device comprise bristles chosen from bristles of hollow cross-section, bristles made of an elastomer, bristles having at least one capillary groove, bristles twisted about their longitudinal axis, bristles having ends that have been ground, bristles having ends forming an excrescence, bristles of varying lengths, bristles formed of fillers chosen from bacteriostatic fillers, magnetic fillers, and fillers capable of improving slip, flocked bristles, and a mixture of such bristles.

24. The device of claim 1, wherein the application element is formed by one of molding, machining, casting, and stamping.

25. The device of claim 24, wherein the application element further comprises a plurality of application members arranged in at least one row.

26. The device of claim 25, wherein the application members comprise a plurality of tines.

27. The device of claim 1, wherein at least over part of its length the application element has a polygonal cross-section.

28. The device of claim 27, wherein the polygonal cross-section is chosen from triangular, square, rectangular, pentagonal, hexagonal, and octagonal.

29. The device of claim 1, wherein the application element has a substantially uniform cross-section over at least part of its length.

30. The device of claim 1, wherein the application element has a changing cross-section over at least part of its length.

31. The device of claim 30, wherein the cross-section changes progressively over at least part of the length of the application element.

32. The device of claim 1, wherein the longitudinal axis of the application element is chosen from a straight axis and a curved axis.

33. An applicator comprising:

the device of claim 1; and a stem having a first end connected to the tail of the device.

34. The applicator of claim 31, wherein the stem has a second end connected to a handling member.

35. The applicator of claim 34, wherein the handling member forms a closure element configured to removably close an opening of a container equipped with the applicator.

36. An assembly for applying a product to keratinous fibers, comprising:

a container for containing the product, the container defining an opening; and the applicator of claim 33, the applicator being configured to be inserted into the opening.

37. The assembly of claim 36, further comprising a wiping member disposed proximate the opening in the container, the wiping member being configured to wipe excess product from the application element.

38. The assembly of claim 36, further comprising the product in the container, wherein the product contains fibers chosen from nylon fibers, rayon fibers, cotton fibers, and viscose fibers.

39. A method of applying a product to keratinous fibers, comprising:

providing the device of claim 1;

loading at least a portion of the application element with a product to be applied to the keratinous fibers; and placing at least the loaded portion of the application element in contact with the keratinous fibers to apply the product to the keratinous fibers.

40. A device for applying a product to keratinous fibers, the device comprising:

a tail having a first end, a second end, and a longitudinal axis X; and an application element having an end extending from the first end of the tail, the application element being oriented along a substantially straight direction, wherein a substantially straight line passing through the center of gravity of at least two transverse cross-sections of the application element extends in a different direction than the axis X.

41. The device of claim 40, wherein the substantially straight line is substantially non-parallel to the axis X.

42. The device of claim 40, wherein the substantially straight line is non-parallel to the axis X.

43. The device of claim 40, wherein the substantially straight line crosses the axis X at a position located axially between the at least two transverse cross-sections.

44. The device of claim 40, wherein the center of gravity of each of the at least two transverse cross-sections is the geometric center of each of the at least two transverse cross-sections.

45. A device for applying a product to keratinous fibers, the device comprising:

an application element formed from a curved twisted wire core holding a plurality of bristles, the application element comprising at least two faces, each of the faces being delimited by two longitudinal edges and extending over at least part of a length of the application element, wherein a line passing through a center of gravity of at least two transverse cross-sections of the application element extends in a substantially different direction than the twisted wire core, and wherein the line has a curvature that is substantially the same as the curvature of the twisted wire core.

46. The device of claim 45, wherein the line is non-parallel to the twisted wire core.

47. The device of claim 45, wherein the line is substantially non-parallel to the twisted wire core.

48. The device of claim 45, wherein the curved line crosses over the twisted wire core at a position located axially between the at least two transverse cross-sections.

49. The device of claim 45, wherein the center of gravity of each of the at least two transverse cross-sections is the geometric center of each of the at least two transverse cross-sections.

50. A device for applying a product to keratinous fibers, the device comprising:

an application element comprising a substantially straight twisted wire core holding a plurality of bristles, the application element having at least two faces, each of the faces being delimited by two longitudinal edges and extending over at least part of the length of the application element, wherein a substantially straight line passing through a center of gravity of the application element and being perpendicular to the at least two transverse cross-sections of the application element is non-parallel to the twisted wire core.

51. The device of claim 50, wherein the substantially straight line crosses the twisted wire core at a position located axially between said at least two transverse cross-sections.

52. A device for applying a product to keratinous fibers, the device comprising:

a tail having a first end, a second end, and a longitudinal axis X; and an application element having an end extending from the first end of the tail, the application element being oriented along a substantially straight direction, wherein a substantially straight line passing through a center of gravity of a volume defined by an outer surface of the application element between a first transverse cross-section of the application element and a second transverse cross-section of the application element and being substantially perpendicular to the first and second transverse cross-sections extends in a substantially different direction than the axis X.

53. The device of claim 52, wherein the substantially straight line is substantially non-parallel to the axis X.

54. The device of claim 52, wherein the substantially straight line is non-parallel to the axis X.

55. The device of claim 52, wherein the substantially straight line intersects the first transverse cross-section and the second transverse cross-section.

56. The device of claim 55, wherein the substantially straight line intersects the first transverse cross-section and the second transverse cross-section at their respective geometric centers.

57. A device for applying a product to keratinous fibers, the device comprising:

an application element formed from a curved twisted wire core holding a plurality of bristles, the application element comprising at least two faces, each of the faces being delimited by two longitudinal edges and extending over at least part of a length of the application element, wherein a substantially straight line passes through a center of gravity of a volume defined by an outer surface of the application element between a first transverse cross-section of the application element and a second transverse cross-section of the application element, wherein the substantially straight line intersects the first transverse cross-section at a first point and intersects the second transverse cross-section at a second point, the substantially straight line being substantially perpendicular to the first transverse cross-section and the second transverse cross-section, and wherein a curved line having a curvature that is substantially the same as the curvature of the twisted wire core passes through the first and second points and extends in a different direction than the twisted wire core.

58. The device of claim 57, wherein the curved line is non-parallel to the twisted wire core.

59. The device of claim 57, wherein the curved line is substantially non-parallel to the twisted wire core.

60. The device of claim 57, wherein the curved line intersects the first transverse cross-section and the second transverse cross-section.

61. The device of claim 60, wherein the curved line intersects the first transverse cross-section and the second transverse cross-section at their respective geometric centers.

62. A device for applying a product to keratinous fibers, the device comprising:

a tail having a longitudinal axis X; and an application element extending from an end of the tail, wherein a plane containing the axis X intersects a peripheral edge of each transverse cross-section of at least one longitudinal region of the application element, the plane intersecting the peripheral edge of each cross-section at a first location and a second location, and wherein, in a first direction along at least a portion of the longitudinal region, a distance from the first location to the axis X increases and a distance from the second location to the axis X decreases.

63. A device for applying a product to keratinous fibers, the device comprising:

an application element formed from a twisted wire core holding a plurality of bristles, the application element being configured such that:

a first location at which a first straight line passing through the twisted wire core intersects a first point on a peripheral edge of a first cross-section of the application element is closer to the core than a second location at which a second straight line, parallel to the first straight line and passing through the twisted wire core, intersects a first point on a peripheral edge of a second cross-section of the application element, and a third location at which said first straight line intersects a second point on the peripheral edge of said first cross-section is farther from the core than a fourth location at which the second straight line intersects a second point on the peripheral edge of the second cross-section.

64. A device for applying a product to keratinous fibers, the device comprising:

an application element having a first longitudinal axis, a first transverse cross-section, and a second transverse cross-section; and a tail portion extending from a first end of the application element, said tail portion having a first end, a second end, and a second longitudinal axis, wherein the first longitudinal axis and the second longitudinal axis cross each other at a location within a volume defined by an outer surface of the application element between the first transverse cross-section and the second transverse cross-section.

65. The device of claim 64, wherein the application element further comprises at least a first face and at least a second face, the first and second faces extending between the first transverse cross-section and the second transverse cross-section.

66. The device of claim 65, wherein the first face and the second face are one of planar, concave, and convex.

67. The device of claim 65, wherein at least a portion of the first face and at least a portion of the second face extend over substantially the same axial position along the second longitudinal axis.

68. The device of claim 67, wherein the first face and the second face extend over substantially the same axial position along the second longitudinal axis.

69. The device of claim 65, wherein each of the first and second faces is delimited by two longitudinal edges.

70. The device of claim 69, wherein the two longitudinal edges delimiting each of the first and second faces are substantially parallel to each other.

71. The device of claim 69, wherein the two longitudinal edges delimiting each of the first and second faces are substantially non-parallel to each other.

72. The device of claim 71, wherein the two longitudinal edges delimiting each of the first and second faces one of converge toward each other and diverge away from each other over at least part of their length.

73. The device of claim 65, wherein the first face forms a first angle with the second longitudinal axis and the second face forms a second angle with the second longitudinal axis, the first angle and the second angle having vertexes facing substantially opposite ends of the application element.

74. The device of claim 73, wherein the first angle and the second angle are substantially equal to each other.

75. The device of claim 73, wherein the first angle and the second angle substantially differ from each other.

76. The device of claim 73, wherein the first and second angles range from approximately 2° to approximately 15°.

77. The device of claim 73, wherein the first and second angles range from approximately 2° to approximately 10°.

78. The device of claim 73, wherein the first and second angles range from approximately 3° to approximately 8°.

79. The device of claim 65, wherein the first face and the second face are disposed substantially opposite each other.

80. The device of claim 65, wherein the first face and the second face are adjacent to each other.

81. The device of claim 65, wherein the application element further comprises a third face having two ends in a plane substantially parallel to the second longitudinal axis.

82. The device of claim 81, wherein the third face is chosen from a planar configuration, a concave configuration, and a convex configuration.

83. The device of claim 64, wherein the application element, over at least part of its length, is substantially centered with respect to the second longitudinal axis.

84. The device of claim 64, wherein the application element, over at least part of its length, is substantially symmetrical with respect to the second longitudinal axis.

85. The device of claim 64, wherein the application element further comprises a plurality of bristles held by a twisted wire core, and wherein said tail portion is formed from a non-bristled portion of said twisted wire core.

86. The device of claim 85, wherein the twisted wire core comprises wire branches twisted to form a helix around a longitudinal axis of the core, and wherein the bristles extend substantially radially with respect to the core and turns of the helix rise from left to right when the device is observed substantially vertically from a front of the device.

87. The device of claim 85, wherein the twisted wire core comprises wire branches twisted to form a helix around a longitudinal axis of the core, and wherein the bristles extend substantially radially with respect to the core and turns of the helix rise from right to left when the device is observed substantially vertically from a front of the device.

88. The device of claim 85, wherein at least some of the bristles of the device comprise bristles chosen from bristles of hollow cross-section, bristles made of an elastomer, bristles having at least one capillary groove, bristles twisted about their longitudinal axis, bristles having ends that have been ground, bristles having ends forming an excrescence, bristles of varying lengths, bristles formed of fillers chosen from bacteriostatic fillers, magnetic fillers, and fillers capable of improving slip, flocked bristles, and a mixture of such bristles.

89. The device of claim 64, wherein the application element is formed by one of molding, machining, casting, and stamping.

90. The device of claim 89, wherein the application element further comprises a plurality of application members arranged in at least one row.

91. The device of claim 90, wherein the application members comprise tines.

92. The device of claim 64, wherein at least over part of its length the application element has a polygonal cross-section.

93. The device of claim 92, wherein the polygonal cross-section is chosen from triangular, square, pentagonal, hexagonal and octagonal.

94. The device of claim 64, wherein the application element has a substantially uniform cross-section over at least part of its length.

95. The device of claim 64, wherein the application element has a changing cross-section over at least part of its length.

96. The device of claim 95, wherein the cross-section changes progressively over at least part of the length of the application element.

97. The device of claim 64, wherein the first longitudinal axis is chosen from a straight axis and a curved axis.

98. The device of claim 64, wherein the first longitudinal axis and the second longitudinal axis are skewed with respect to each other.

99. The device of claim 64, wherein the first longitudinal axis is in a first plane and the second longitudinal axis is in a second plane and the first and the second planes are parallel to each other.

100. An applicator comprising:

the device of claim 64; and a stem having a first end connected to the tail portion of the device.

101. The applicator of claim 100, wherein the stem has a second end connected to a handling member.

102. The applicator of claim 101, wherein the handling member forms a closure element configured to removably close an opening of a container equipped with the applicator.

103. An assembly for applying a product to keratinous fibers, comprising:

a container for containing the product, the container defining an opening; and the applicator of claim 100, the applicator being configured to be inserted into the opening.

104. The assembly of claim 103, further comprising a wiping member disposed proximate the opening in the container, the wiping member being configured to wipe excess product from the application element.

105. The assembly of claim 103, further comprising the product in the container, wherein the product contains fibers chosen from nylon fibers, rayon fibers, cotton fibers, and viscose fibers.

106. A method of applying a product to keratinous fibers, comprising:

providing the device of claim 64;

loading at least a portion of the application element with a product to be applied to the keratinous fibers; and placing at least the loaded portion of the application element in contact with the keratinous fibers to apply the product to the keratinous product.

107. A device for applying a product to keratinous fibers, the device comprising:

an application element having a first longitudinal axis, a first transverse cross-section, and a second transverse cross-section; and a tail portion extending from a first end of the application element, said tail portion having a first end, a second end, and a second longitudinal axis, wherein the first longitudinal axis and the second longitudinal axis are non-parallel and are closest to each other at a location within a volume defined by an outer surface of the application element between the first transverse cross-section and the second transverse cross-section.

108. The device of claim 107, wherein the application element further comprises at least a first face and at least a second face, the first and second faces extending between the first transverse cross-section and the second transverse cross-section.

109. The device of claim 108, wherein each of the two faces is delimited by two longitudinal edges.

110. The device of claim 108, wherein the first face forms a first angle with the second longitudinal axis and the second face forms a second angle with the second longitudinal axis, the first angle and the second angle having vertexes facing substantially opposite ends of the application element.

111. The device of claim 110, wherein the first and second angles substantially differ from each other.

112. The device of claim 110, wherein the first and second angles are substantially the same.

113. The device of claim 108, wherein the first face and the second face are disposed substantially opposite each other.

114. The device of claim 108, wherein the first face and the second face are adjacent to each other.

115. The device of claim 107, wherein the application element further comprises a plurality of bristles held by a twisted wire core, and wherein said tail portion is formed from a non-bristled portion of said twisted wire core.

116. The device of claim 107, wherein the application element is formed by one of molding, machining, casting, and stamping.

117. The device of claim 107, wherein at least over part of its length the application element has a polygonal cross-section.

118. The device of claim 107, wherein the application element has a substantially uniform cross-section over at least part of its length.

119. The device of claim 107, wherein the application element has a changing cross-section over at least part of its length.

120. The device of claim 107, wherein the first longitudinal axis is chosen from a straight axis and a curved axis.

121. The device of claim 107, wherein the first longitudinal axis and the second longitudinal axis are skewed with respect to each other.

122. The device of claim 107, wherein the first longitudinal axis is in a first plane and the second longitudinal axis is in a second plane and the first and the second planes are parallel to each other.

123. An applicator comprising:

the device of claim 107; and a stem having a first end connected to the tail portion of the device.

124. The applicator of claim 123, wherein the stem has a second end connected to a handling member.

125. The applicator of claim 124, wherein the handling member forms a closure element configured to removably close an opening of a container equipped with the applicator.

126. An assembly for applying a product to keratinous fibers, comprising:

a container for containing the product, the container defining an opening; and the applicator of claim 123, the applicator being configured to be inserted into the opening.

127. The assembly of claim 126, further comprising a wiping member disposed proximate the opening in the container, the wiping member being configured to wipe excess product from the application element.

128. The assembly of claim 126, further comprising the product in the container, wherein the product contains fibers chosen from nylon fibers, rayon fibers, cotton fibers, and viscose fibers.

129. A method of applying a product to keratinous fibers, comprising:

providing the device of claim 107;

loading at least a portion of the application element with a product to be applied to the keratinous fibers; and placing at least the loaded portion of the application element in contact with the keratinous fibers to apply the product to the keratinous product.

130. A device for applying a product to keratinous fibers, the device comprising:

an application element comprising a twisted wire core holding a plurality of bristles, wherein a longitudinal axis of at least a portion of the application element extending from a first transverse cross-section to a second transverse cross-section crosses the twisted wire core at a location within a volume defined by an outer surface of the portion of the application element.

131. The device of claim 130, wherein the application element further comprises at least a first face and at least a second face, the first and second faces extending between the first transverse cross-section and the second transverse cross-section.

132. The device of claim 131, wherein each of the first and second faces is delimited by two longitudinal edges.

133. The device of claim 131, wherein the first face forms a first angle with the twisted wire core and the second face forms a second angle with the twisted wire core, the first angle and the second angle having vertexes facing substantially opposite ends of the application element.

134. The device of claim 131, wherein the first face and the second face are disposed substantially opposite each other.

135. The device of claim 131, wherein the first face and the second face are adjacent to each other.

136. The device of claim 130, further comprising a tail portion formed from a non-bristled portion of said twisted wire core.

137. The device of claim 130, wherein at least some of the bristles of the device comprise bristles chosen from bristles of hollow cross-section, bristles made of an elastomer, bristles having at least one capillary groove, bristles twisted about their longitudinal axis, bristles having ends that have been ground, bristles having ends forming an excrescence, bristles of varying lengths, bristles formed of fillers chosen from bacteriostatic fillers, magnetic fillers, and fillers capable of improving slip, flocked bristles, and a mixture of such bristles.

138. The device of claim 130, wherein at least over part of its length the application element has a polygonal cross-section.

139. The device of claim 130, wherein the twisted wire core is chosen from a straight core and a curved core.

140. An applicator comprising:

the device of claim 130; and a stem having a first end connected to the application element.

141. The applicator of claim 140, wherein the stem has a second end connected to a handling member.

142. The applicator of claim 141, wherein the handling member forms a closure element configured to removably close an opening of a container associated with the applicator.

143. An assembly for applying a product to keratinous fibers, comprising:

a container for containing the product, the container defining an opening; and the applicator of claim 140, the applicator being configured to be inserted into the opening.

144. The assembly of claim 143, further comprising a wiping member disposed proximate the opening in the container, the wiping member being configured to wipe excess product from the application element.

145. The assembly of claim 143, further comprising the product in the container, wherein the product contains fibers chosen from nylon fibers, rayon fibers, cotton fibers, and viscose fibers.

146. A method of applying a product to keratinous fibers, comprising:

providing the device of claim 130;

loading at least a portion of the application element with a product to be applied to the keratinous fibers; and placing at least the loaded portion of the application element in contact with the keratinous fibers to apply the product to the keratinous product.

147. A device for applying a product to keratinous fibers, the device comprising:

an application element comprising a twisted wire core holding a plurality of bristles, wherein a longitudinal axis of at least a portion of the application element extending from a first transverse cross-section to a second transverse cross-section is closest to the twisted wire core at a location within a volume defined by an outer surface of the portion of the application element, and wherein the longitudinal axis and the twisted wire core are non-parallel.

148. The device of claim 147, wherein the application element further comprises at least a first face and at least a second face, the first and second faces extending between the first transverse cross-section and the second transverse cross-section.

149. The device of claim 148, wherein each of the first and second faces is delimited by two longitudinal edges.

150. The device of claim 148, wherein the first face forms a first angle with the twisted wire core and the second face forms a second angle with the twisted wire core, the first angle and the second angle having vertexes facing substantially opposite ends of the application element.

151. The device of claim 148, wherein the first face and the second face are disposed substantially opposite each other.

152. The device of claim 148, wherein the first face and the second face are adjacent to each other.

153. The device of claim 147, further comprising a tail portion formed from a non-bristled portion of said twisted wire core.

154. The device of claim 147, wherein the twisted wire core comprises wire branches twisted to form a helix around a longitudinal axis of the core, and wherein the bristles extend substantially radially with respect to the core and turns of the helix rise from left to right when the device is observed substantially vertically from a front of the device.

155. The device of claim 147, wherein the twisted wire core comprises wire branches twisted to form a helix around a longitudinal axis of the core, and wherein the bristles extend substantially radially with respect to the core and turns of the helix rise from right to left when the device is observed substantially vertically from a front of the device.

156. The device of claim 147, wherein at least some of the bristles of the device comprise bristles chosen from bristles of hollow cross-section, bristles made of an elastomer, bristles having at least one capillary groove, bristles twisted about their longitudinal axis, bristles having ends that have been ground, bristles having ends forming an excrescence, bristles of varying lengths, bristles formed of fillers chosen from bacteriostatic fillers, magnetic fillers, and fillers capable of improving slip, flocked bristles, and a mixture of such bristles.

157. The device of claim 147, wherein at least over part of its length the application element has a polygonal cross-section.

158. The device of claim 147, wherein the twisted wire core is chosen from a straight core and a curved core.

159. An applicator comprising:

the device of claim 147; and a stem having a first end connected to the application element.

160. The applicator of claim 159, wherein the stem has a second end connected to a handling member.

161. The applicator of claim 160, wherein the handling member forms a closure element configured to removably close an opening of a container equipped with the applicator.

162. An assembly for applying a product to keratinous fibers, comprising:

a container for containing the product, the container defining an opening; and the applicator of claim 159, the applicator being configured to be inserted into the opening.

163. The assembly of claim 162, further comprising a wiping member disposed proximate the opening in the container, the wiping member being configured to wipe excess product from the application element.

164. The assembly of claim 162, further comprising the product in the container, wherein the product contains fibers chosen from nylon fibers, rayon fibers, cotton fibers, and viscose fibers.

165. A method of applying a product to keratinous fibers, comprising:

providing the device of claim 147;

loading at least a portion of the application element with a product to be applied to the keratinous fibers; and placing at least the loaded portion of the application element in contact with the keratinous fibers to apply the product to the keratinous product.

166. A device for applying a product to keratinous fibers, the device comprising:

an application element; and a tail portion extending from a first end of the application element, the tail portion having a first end, a second end, and a longitudinal axis, wherein the longitudinal axis of the tail portion passes through at least a first transverse cross-section of the application element and a second transverse cross-section of the application element, and wherein the longitudinal axis of the tail portion crosses a longitudinal axis of a portion of the application element extending between the first transverse cross-section and the second transverse cross-section at a location within a volume defined by an outer surface of the portion of the application element.

167. The device of claim 166, wherein the application element further comprises at least a first face and at least a second face, the first and second faces extending between the first transverse cross-section and the second transverse cross-section.

168. The device of claim 167, wherein each of the first and second faces is delimited by two longitudinal edges.

169. The device of claim 167, wherein the first face forms a first angle with the longitudinal axis of the tail portion and the second face forms a second angle with the longitudinal axis of the tail portion, the first angle and the second angle having vertexes facing substantially opposite ends of the application element.

170. The device of claim 167, wherein the first face and the second face are disposed substantially opposite each other.

171. The device of claim 167, wherein the first face and the second face are adjacent to each other.

172. The device of claim 166, wherein the application element further comprises a plurality of bristles held by a twisted wire core, and wherein said tail portion is formed from a non-bristled portion of said twisted wire core.

173. The device of claim 166, wherein the application element is formed by one of molding, machining, casting, and stamping.

174. The device of claim 166, wherein at least over part of its length the application element has a polygonal cross-section.

175. The device of claim 166, wherein the longitudinal axis of the application element is chosen from a straight axis and a curved axis.

176. The device of claim 166, wherein the longitudinal axis of the tail portion and the longitudinal axis of the portion of the application element are skewed with respect to each other.

177. The device of claim 166, wherein the longitudinal axis of the tail portion is in a first plane and the longitudinal axis of the portion of the application element is in a second plane and the first and the second planes are parallel to each other.

178. An applicator comprising:

the device of claim 166; and a stem having a first end connected to the tail portion of the device.

179. The applicator of claim 178, wherein the stem has a second end connected to a handling member.

180. The applicator of claim 179, wherein the handling member forms a closure element configured to removably close an opening of a container equipped with the applicator.

181. An assembly for applying a product to keratinous fibers, comprising:

a container for containing the product, the container defining an opening; and the applicator of claim 178, the applicator being configured to be inserted into the opening.

182. The assembly of claim 181, further comprising a wiping member disposed proximate the opening in the container, the wiping member being configured to wipe excess product from the application element.

183. The assembly of claim 181, further comprising the product in the container, wherein the product contains fibers chosen from nylon fibers, rayon fibers, cotton fibers, and viscose fibers.

184. A method of applying a product to keratinous fibers, comprising:

providing the device of claim 166;

loading at least a portion of the application element with a product to be applied to the keratinous fibers; and placing at least the loaded portion of the application element in contact with the keratinous fibers to apply the product to the keratinous product.

185. A device for applying a product to keratinous fibers, the device comprising:

an application element having at least a first face and a second face extending along at least a portion of the length of the application element; and a tail portion extending from a first end of the application element, the tail portion having a first end, a second end, and a longitudinal axis, wherein a distance from the first face to the longitudinal axis of the tail portion at a first transverse cross-section of the application element is greater than a distance from the first face to the longitudinal axis of the tail portion at a second transverse cross-section of the application element, and wherein a distance from a second face to the longitudinal axis of the tail portion at the first transverse cross-section of the application element is less than a distance from the second face to the longitudinal axis of the tail portion at the second transverse cross-section of the application element.

186. The device of claim 185, wherein at least a portion of the first face and at least a portion of the second face extend over substantially the same axial position along the second longitudinal axis.

187. The device of claim 185, wherein each of the first and second faces is delimited by two longitudinal edges.

188. The device of claim 185, wherein the first face forms a first angle with the longitudinal axis of the tail portion and the second face forms a second angle with the longitudinal axis of the tail portion, the first angle and the second angle having vertexes facing substantially opposite ends of the application element.

189. The device of claim 185, wherein the first face and the second face are disposed substantially opposite each other.

190. The device of claim 185, wherein the first face and the second face are adjacent to each other.

191. The device of claim 185, wherein the application element further comprises a third face having two ends in a plane substantially parallel to the longitudinal axis of the tail portion.

192. The device of claim 185, wherein the application element further comprises a plurality of bristles held by a twisted wire core, and wherein said tail portion is formed from a non-bristled portion of said twisted wire core.

193. The device of claim 185, wherein the application element is formed by one of molding, machining, casting, and stamping.

194. The device of claim 185, wherein at least over part of its length the application element has a polygonal cross-section.

195. An applicator comprising:

the device of claim 185; and a stem having a first end connected to the tail portion of the device.

196. The applicator of claim 195, wherein the stem has a second end connected to a handling member.

197. The applicator of claim 196, wherein the handling member forms a closure element configured to removably close an opening of a container equipped with the applicator.

198. An assembly for applying a product to keratinous fibers, comprising:

a container for containing the product, the container defining an opening; and the applicator of claim 195, the applicator being configured to be inserted into the opening.

199. The assembly of claim 198, further comprising a wiping member disposed proximate the opening in the container, the wiping member being configured to wipe excess product from the application element.

200. The assembly of claim 198, further comprising the product in the container, wherein the product contains fibers chosen from nylon fibers, rayon fibers, cotton fibers, and viscose fibers.

201. A method of applying a product to keratinous fibers, comprising:

providing the device of claim 185;

loading at least a portion of the application element with a product to be applied to the keratinous fibers; and placing at least the loaded portion of the application element in contact with the keratinous fibers to apply the product to the keratinous product.

202. A device for applying a product to keratinous fibers, the device comprising:

an application element having at least two faces extending along at least a portion of a length of the application element; and a tail portion having a first end, a second end, and a longitudinal axis, the first end of the tail portion being connected to the first end of the application element, wherein, in a lengthwise direction along at least the portion of the application element, at least one of the at least two faces converges toward the longitudinal axis of the tail portion and at least another of the at least two faces diverges away from the longitudinal axis of the tail portion.

203. The device of claim 202, wherein the at least two faces are one of planar, concave, and convex.

204. The device of claim 202, wherein at least a portion of each of the at least two faces extends over substantially the same axial position along the second longitudinal axis.

205. The device of claim 202, wherein each of the at least two faces is delimited by two longitudinal edges.

206. The device of claim 202, wherein a first of the at least two faces forms a first angle with the longitudinal axis of the tail portion and a second of the at least two faces forms a second angle with the longitudinal axis of the tail portion, the first angle and the second angle having vertexes facing substantially opposite ends of the application element.

207. The device of claim 202, wherein the at least two faces are disposed substantially opposite each other.

208. The device of claim 202, wherein the at least two faces are adjacent to each other.

209. The device of claim 202, wherein the application element further comprises a plurality of bristles held by a twisted wire core, and wherein said tail portion is formed from a non-bristled portion of said twisted wire core.

210. The device of claim 202, wherein the application element is formed by one of molding, machining, casting, and stamping.

211. The device of claim 202, wherein at least over part of its length the application element has a polygonal cross-section.

212. An applicator comprising:

the device of claim 202; and a stem having a first end connected to the tail portion of the device.

213. The applicator of claim 212, wherein the stem has a second end connected to a handling member.

214. The applicator of claim 213, wherein the handling member forms a closure element configured to removably close an opening of a container equipped with the applicator.

215. An assembly for applying a product to keratinous fibers, comprising:

a container for containing the product, the container defining an opening; and the applicator of claim 212, the applicator being configured to be inserted into the opening.

216. The assembly of claim 215, further comprising a wiping member disposed proximate the opening in the container, the wiping member being configured to wipe excess product from the application element.

217. The assembly of claim 215, further comprising the product in the container, wherein the product contains fibers chosen from nylon fibers, rayon fibers, cotton fibers, and viscose fibers.

218. A method of applying a product to keratinous fibers, comprising:

providing the device of claim 202;

loading at least a portion of the application element with a product to be applied to the keratinous fibers; and placing at least the loaded portion of the application element in contact with the keratinous fibers to apply the product to the keratinous product.

219. A device for applying a product to keratinous fibers, the device comprising:

an application element comprising a twisted wire core holding a plurality of bristles, the application element having at least a first face and a second face extending along at least a portion of the twisted wire core;

wherein a distance from the first face to the core at a first transverse cross-section of the application element is greater than a distance from the first face to the core at a second transverse cross-section of the application element, and wherein a distance from a second face to the core at the first transverse cross-section of the application element is less than a distance from the second face to the core at the second transverse cross-section of the application element.

220. The device of claim 219, wherein the first face and the second face are one of planar, concave, and convex.

221. The device of claim 219, wherein at least a portion of the first face and at least a portion of the second face extend over substantially the same axial position along the core.

222. The device of claim 219, wherein each of the first and second faces is delimited by two longitudinal edges.

223. The device of claim 219, wherein a first face of the at least two faces forms a first angle with the core and a second face of the at least two faces forms a second angle with the core, the first angle and the second angle having vertexes facing substantially opposite ends of the application element.

224. The device of claim 219, wherein the first face and the second face are disposed substantially opposite each other.

225. The device of claim 219, wherein the first face and the second face are adjacent to each other.

226. The device of claim 219, wherein the application element further comprises a third face having two ends in a plane substantially parallel to the longitudinal axis of the tail portion.

227. The device of claim 219, further comprising a tail portion formed from a non-bristled portion of said twisted wire core.

228. The device of claim 219, wherein at least over part of its length the application element has a polygonal cross-section.

229. The device of claim 219, wherein the twisted wire core is one of straight and curved.

230. An applicator comprising:

the device of claim 219; and a stem having a first end connected to the application element.

231. The applicator of claim 230, wherein the stem has a second end connected to a handling member.

232. The applicator of claim 231, wherein the handling member forms a closure element configured to removably close an opening of a container equipped with the applicator.

233. An assembly for applying a product to keratinous fibers, comprising:

a container for containing the product, the container defining an opening; and the applicator of claim 230, the applicator being configured to be inserted into the opening.

234. The assembly of claim 233, further comprising a wiping member disposed proximate the opening in the container, the wiping member being configured to wipe excess product from the application element.

235. The assembly of claim 233, further comprising the product in the container, wherein the product contains fibers chosen from nylon fibers, rayon fibers, cotton fibers, and viscose fibers.

236. A method of applying a product to keratinous fibers, comprising:

providing the device of claim 219;

loading at least a portion of the application element with a product to be applied to the keratinous fibers; and placing at least the loaded portion of the application element in contact with the keratinous fibers to apply the product to the keratinous product.

237. A device for applying a product to keratinous fibers, the device comprising:

an application element comprising a twisted wire core holding a plurality of bristles, the application element having at least two faces extending along at least a portion of the twisted wire core, wherein, in a lengthwise direction along at least the portion of the core, at least one of the at least two faces converges toward the core and at least another of the at least two faces diverges away from core.

238. The device of claim 237, wherein the at least two faces are one of planar, concave, and convex.

239. The device of claim 237, wherein at least a portion of each of the at least two faces extends over substantially the same axial position along the core.

240. The device of claim 237, wherein each of the at least two faces is delimited by two longitudinal edges.

241. The device of claim 237, wherein a first face of the at least two faces forms a first angle with the core and a second face of the at least two faces forms a second angle with the core, the first angle and the second angle having vertexes facing substantially opposite ends of the application element.

242. The device of claim 237, wherein the at least two faces are disposed substantially opposite each other.

243. The device of claim 237, wherein the at least two faces are adjacent to each other.

244. The device of claim 237, wherein the application element further comprises a third face having two ends in a plane substantially parallel to the core.

245. The device of claim 237, further comprising a tail portion formed from a non-bristled portion of said twisted wire core.

246. The device of claim 237, wherein at least over part of its length the application element has a polygonal cross-section.

247. The device of claim 237, wherein the core is one of straight and curved.

248. An applicator comprising:

the device of claim 237; and a stem having a first end connected to the application element.

249. The applicator of claim 248, wherein the stem has a second end connected to a handling member.

250. The applicator of claim 249, wherein the handling member forms a closure element configured to removably close an opening of a container equipped with the applicator.

251. An assembly for applying a product to keratinous fibers, comprising:

a container for containing the product, the container defining an opening; and the applicator of claim 248, the applicator being configured to be inserted into the opening.

252. The assembly of claim 251, further comprising a wiping member disposed proximate the opening in the container, the wiping member being configured to wipe excess product from the application element.

253. The assembly of claim 251, further comprising the product in the container, wherein the product contains fibers chosen from nylon fibers, rayon fibers, cotton fibers, and viscose fibers.

254. A method of applying a product to keratinous fibers, comprising:

providing the device of claim 237;

loading at least a portion of the application element with a product to be applied to the keratinous fibers; and placing at least the loaded portion of the application element in contact with the keratinous fibers to apply the product to the keratinous product.

* * * * *

UNITED STATES PATENT AND TRADEMARK OFFICE

CERTIFICATE OF CORRECTION

PATENT NO. : 6,494,215 B2
DATED : December 17, 2002
INVENTOR(S) : Jean-Louis H. Gueret It is certified that error appears in the above-identified patent and that said Letters Patent is hereby corrected as shown below:

Column 21,
Line 55, replace "claim 31" with -- claim 33 --;

Column 26,
Line 62, replace "keratinous product" with -- keratinous fibers --;

Column 28,
Line 18, replace "keratinous product" with -- keratinous fibers --;

Column 29,
Line 29, replace "keratinous product" with -- keratinous fibers --;

Column 30,
Line 53, replace "keratinous product" with -- keratinous fibers --;

Column 32,
Line 6, replace "keratinous product" with -- keratinous fibers --;

Column 33,
Line 22, replace "keratinous product" with -- keratinous fibers --;

Column 34,
Line 28, replace "keratinous product" with -- keratinous fibers --;

Column 35,
Line 40, replace "keratinous product" with -- keratinous fibers --;

UNITED STATES PATENT AND TRADEMARK OFFICE

CERTIFICATE OF CORRECTION

PATENT NO. : 6,494,215 B2
DATED : December 17, 2002
INVENTOR(S) : Jean-Louis H. Gueret It is certified that error appears in the above-identified patent and that said Letters Patent is hereby corrected as shown below:

Column 36,
Line 52, replace "keratinous product" with -- keratinous fibers --;

Signed and Sealed this

Seventeenth Day of June, 2003

JAMES E. ROGAN
*Director of the United States Patent and Trademark Office*